US010822903B2

(12) United States Patent
Ye et al.

(10) Patent No.: US 10,822,903 B2
(45) Date of Patent: Nov. 3, 2020

(54) NATURAL GAS HYDRATE ROTARY PRESSURE-RETAINING CORER

(71) Applicant: Guangzhou Marine Geological Survey, Guangzhou (KR)

(72) Inventors: Jianliang Ye, Guangzhou (CN); Qiuping Lu, Guangzhou (CN); Haijun Qiu, Guangzhou (CN); Jingan Lu, Guangzhou (CN); Beibei Kou, Guangzhou (CN); Yanjiang Yu, Gaungzhou (CN); Zenggui Kuang, Guangzhou (CN); Chengzhi Yang, Guangzhou (CN); Liang Chen, Guangzhou (CN)

(73) Assignee: GUANGZHOU MARINE GEOLOGICAL SURVEY, Guangzhou (CN)

( * ) Notice: Subject to any disclaimer, the term of this patent is extended or adjusted under 35 U.S.C. 154(b) by 0 days.

(21) Appl. No.: 16/537,016

(22) Filed: Aug. 9, 2019

(65) Prior Publication Data

US 2020/0181998 A1 Jun. 11, 2020

(30) Foreign Application Priority Data

Dec. 11, 2018 (CN) ..... 2018 1 1508662

(51) Int. Cl.

| | |
|---|---|
| ***E21B 25/10*** | (2006.01) |
| ***E21B 25/08*** | (2006.01) |
| ***E21B 34/14*** | (2006.01) |

(52) U.S. Cl.

CPC ..... *E21B 25/10* (2013.01); *E21B 25/08* (2013.01); *E21B 34/14* (2013.01); *E21B 2200/04* (2020.05)

(58) Field of Classification Search

CPC ..... E21B 25/00; E21B 25/10

See application file for complete search history.

(56) References Cited

U.S. PATENT DOCUMENTS

2014/0262532 A1* 9/2014 Mizuguchi ..... E21B 25/005 175/244

FOREIGN PATENT DOCUMENTS

| | | |
|---|---|---|
| CN | 102866037 A | 1/2013 |
| CN | 107727432 A | 2/2018 |

* cited by examiner

*Primary Examiner* — Tara Schimpf

(74) *Attorney, Agent, or Firm* — Muncy, Geissler, Olds and Lowe, P.C.

(57) ABSTRACT

The present invention relates to a natural gas hydrate rotary pressure-retaining corer, including an outer tube assembly and an inner tube assembly installed inside the outer tube assembly. The inner tube assembly includes an inner tube assembly a and an inner tube assembly b. The inner tube assembly a includes a spearhead, a latch mechanism, a long tube, a middle tube sub, a short joint, a sealing sub, a connecting tube, a middle tube and a pressure-retaining ball valve closing sealing mechanism connected sequentially from top to bottom. The inner tube assembly b includes a lifting device, a latch suspension mechanism, an spirol pin sub, a single-action mechanism, a dapter, an adjustment joint, a connecting tube, a sealing mechanism, a connecting long tube, a connecting long tube sub and a core barrel connected sequentially from top to bottom.

10 Claims, 17 Drawing Sheets

NATURAL GAS HYDRATE ROTARY PRESSURE-RETAINING CORER

CROSS-REFERENCE TO RELATED APPLICATIONS

This application claims the benefit of Chinese Patent Application No. 201811508662.4, filed on Dec. 11, 2018 in the National Intellectual Property Administration Of China, the disclosure of which is incorporated herein by reference in its entirety.

TECHNICAL FIELD

The present invention relates to the field of drilling technology, and in particular to a natural gas hydrate rotary pressure-retaining corer.

BACKGROUND

Natural gas hydrate is a resource-rich and efficient clean energy. It is the strategic high point of global energy development in the future. Natural gas hydrates are found in sediments below the seabed of the deep sea continental slope or buried in the polar areas. Because natural gas hydrates will not decompose only in a stable pressure-retaining state, it is necessary to use a pressure-retaining method for coring. The ordinary corer generally does not have the airtightness and cannot retain the pressure. The coring effect of such a corer is not ideal. In addition, the common corer has a complicated structure and numerous components, which causes inconvenient maintenance and short service life. At the same time, the common corer is difficult to perform coring in hard formation due to the coring bit, and thus the range is small. Therefore, it is an urgent problem to be solved in the art to provide a corer which has good pressure-retaining effect, can adapt to hard formation and is easy to maintain.

SUMMARY

In view of the deficiencies of the prior art, the embodiment of the present invention provides a natural gas hydrate rotary pressure-retaining corer, which can realize pressure-retaining coring, and is more convenient to maintain and can be adapted to coring for hard formation.

The technical solution of the embodiment is a natural gas hydrate rotary pressure-retaining corer.

Furthermore, the inner tube assembly includes an inner tube assembly a and an inner tube assembly b, the inner tube assembly b is mounted inside the inner tube assembly a and is axially movable upward along the inner tube assembly a and is axially fixed in the inner tube assembly a through a latch suspension mechanism, the inner tube assembly b is axially kept and does not move, the inner tube assembly b can only move upward axially after completing latch releasing, the inner tube assembly a includes a spearhead, a latch mechanism, a long tube, a middle tube sub, a short joint, a sealing sub, a connecting tube, a middle tube and a pressure-retaining ball valve closing sealing mechanism sequentially connected from top to bottom; the inner tube assembly b includes a lifting device, a latch suspension mechanism, an spirol pin sub, a single-action mechanism, a dapter, an adjustment joint, a connecting tube, a sealing mechanism, a connecting long tube, a connecting long tube short joint and a core barrel sequentially connected from top to bottom;

the latch mechanism and the latch suspension mechanism cooperate with each other, so that the core barrel is axially fixed before retrieved by wireline;

the core barrel is located inside the middle tube;

the pressure-retaining ball valve closing sealing mechanism comprises a spring limit ring, a ball valve drive sleeve, a spring, a ball valve drive sleeve spring shoulder, a ball valve sub shoulder, an upper ball valve seat sealing ring, an upper ball valve seat, a ball valve sub, a ball valve, a ball valve closing drive pin, a ball valve shaft, a ball valve closing sliding groove, a ball valve sub oblong hole, a ball valve sub window, a lower ball valve seat, a lower ball valve seat seal ring, a load-bearing spring and a ball valve lower gland; and the ball valve is provided with the ball valve shaft and the ball valve closing sliding groove, and the ball valve is provided with a through hole for the core barrel to pass through;

the upper end of the ball valve sub is connected to the lower end of the middle tube, the ball valve sub sealing ring is arranged at the joint of the ball valve sub and the middle tube, the hollow interior of the ball valve sub is provided with the ball valve sub window, the middle of the ball valve sub is provided with the ball valve sub oblong hole, the ball valve closing drive pin located in the ball valve sub oblong hole is fixed on the ball valve sub, and the ball valve closing drive pin protrudes into the ball valve closing sliding groove of the ball valve;

the ball valve is fixedly disposed in the ball valve sub window of the ball valve sub through the ball valve shaft, one end of the ball valve shaft is connected to the ball valve, and the other end protrudes into the ball valve sub long hole, and can rotate and slide in the ball valve sub oblong hole;

the ball valve sub is internally provided with the upper ball valve seat and the lower ball valve seat, the upper ball valve seat and the lower ball valve seat can both slide axially in the ball valve sub, the upper end of the ball valve sub is provided with the ball valve sub shoulder, and the ball valve sub is connected to the middle tube;

the upper end of the upper ball valve seat is connected to the lower end of the ball valve drive sleeve, the lower end of the upper ball valve seat is in contact with the upper end of the ball valve, the ball valve drive sleeve is located below the connecting long tube sub, the ball valve drive sleeve is located between the core barrel and the middle tube, the spring is also provided between the ball valve drive sleeve and the middle tube, the spring is sleeved on the ball valve drive sleeve, the upper end of the spring is in contact with the spring limit ring, the spring limit ring is restricted by the middle tube shoulder by concave-convex fitting, the spring limit ring is located between the core barrel and the middle tube, the lower end of the spring is in contact with the ball valve drive sleeve spring shoulder and is held by the ball valve drive sleeve spring shoulder, the ball valve drive sleeve spring shoulder holds the spring limit ring through the spring, and the ball valve drive sleeve spring shoulder is located above the ball valve sub shoulder;

the pressure-retaining ball valve closing sealing mechanism cooperates with the core barrel to realize that the ball valve slides downward and flips by 90°;

the single-action mechanism is located inside the middle tube sub and is located below the spirol pin sub, the single-action mechanism is connected to the dapter through the bearing sleeve, the dapter is connected to the upper end of the adjustment joint, the adjustment joint is sleeved with an adjustment mechanism lock nut, the adjustment mechanism lock nut is disposed at the lower end of the dapter, the adjustment joint is located at the inner wall of the short joint, the lower end of the adjustment joint is connected to the upper end of the connecting tube, the lower end of the connecting tube is connected to the sealing mechanism; and the sealing mechanism is located inside the connecting tube and can move axially along the connecting tube.

Furthermore, the specific process of the pressure-retaining ball valve closing sealing mechanism cooperating with the core barrel to realize that the ball valve slides downward and flips by 90° is as follows.

Before coring and retrieving by wireline, the core barrel passes downward through the through hole of the ball valve. The edge of the ball valve is closely attached to the core barrel. The core barrel restricts the ball valve from flipping down. The ball valve is contacted by the core barrel to make the ball valve hold the ball valve seat upward. The upper ball valve seat holds the ball valve driving sub upward to move upward. The ball valve drive sleeve spring shoulder on the ball valve drive sleeve correspondingly moves upward. The spring limit ring is limited by the middle pipe shoulder on the middle pipe. The spring is compressed and the elastic potential energy is increased. When the coring is completed and the retrieving by wireline is performed, after the core barrel is pulled upward from the through hole of the ball valve, the core barrel no longer restricts the ball valve from flipping down. The spring has sufficient elastic potential energy. The spring thrust is greater than the load-bearing spring thrust, so that the ball valve moves downward as a whole along the ball valve sub oblong hole under the thrust given by the spring. During the downward movement of the ball valve, the ball valve performs complex movement of sliding and rotating around the ball valve fixed on the ball valve sub and simultaneously gives the ball valve a flipping torque and drives the ball valve to flip by 90°. When the ball valve reaches the downward limit position, the load-bearing spring is compressed to the lower ball seat to be in contact with the ball valve lower gland.

Furthermore, the lower end of the pressure-retaining ball valve closing sealing mechanism is connected to a flushing mechanism for flushing the core barrel, and the outlet passage is a gap between the outer tube coring bit and the cutting shoe and a gap between the core barrel and the cutting shoe.

Furthermore, the sealing mechanism comprises a quick-plug check valve pressure measuring joint, a pressure passage, a sealing joint sealing ring, a sealing joint and a sealing joint shoulder, the upper end of the sealing joint is connected to the lower end of the connecting tube, the middle portion of the sealing joint is provided with the axial pressure passage, the quick-plug check valve pressure measuring joint protrudes into the pressure passage, the sealing joint is sleeved with the sealing joint sealing ring, the sealing joint is provided with the sealing joint shoulder on each side, and the lower end of the sealing joint is connected to the upper end of the connecting long tube.

Furthermore, the attachment between the ball valve sub and the upper ball valve seat is provided with the upper ball valve seat sealing ring, the attachment between the ball valve sub and the lower ball valve seat is provided with the lower joint valve seat sealing ring; the lower ball valve seat is provided with the load-bearing spring and the ball valve lower gland from top to bottom, the upper and lower ends of the load-bearing spring are respectively connected to the lower ball valve seat and the ball valve lower gland, and the upper end of the lower ball valve seat is in contact with the lower end of the ball valve.

Furthermore, the ball valve and the lower ball valve seat are in floating contact.

Furthermore, the latch mechanism comprises a latch a, a latch bracket a, a latch releasing tube, an inlet, a latch bracket long pin hole, a latch bracket tube a, and a latch releasing tube inclined portion, the latch a is disposed in the latch chamber, and is connected to the latch bracket a, the latch bracket a is connected and disposed inside the latch releasing tube, the latch releasing tube is fixedly connected to the spearhead, the bottom end of the latch releasing tube is provided with the latch releasing tube inclined portion for removing the latch from the latch chamber, the inlet is provided on the side wall of the latch releasing tube, and the latch bracket tube long pin hole is disposed inside the middle cavity of the latch bracket tube a.

Furthermore, the lifting device comprises a pulling tube, a pulling tube long pin hole and a first spirol pin, the pulling tube long pin hole is disposed inside the pulling tube; the first spirol pin is fixedly disposed on the latch releasing tube after passing through the latch bracket tube long pin hole and the pulling tube long pin hole, the central axes of the latch bracket tube long pin hole and the pulling tube long pin hole are on the same straight line, and the pulling tube, the latch bracket tube a and the latch releasing tube adopt a sleeve connection.

Furthermore, the latch suspension mechanism comprises a latch bracket tube b, a latch bracket tube outlet, a latch bracket b, a latch chamber, a shrapnel opening, a latch b, a latch chamber, a latch bracket tube inclined portion and a shearing copper pin; the upper portion of the latch suspension mechanism is disposed inside the long tube, and the lower portion is disposed inside the middle tube sub.

The beneficial effects of the present invention are as follows: The present invention has the following beneficial technical effects:

1. The ball valve of the pressure-retaining ball valve closing sealing mechanism slides down and flips by 90°. The ball valve is in sealing contact with the upper ball valve seat to achieve the pressure-retaining effect in the upper portion of the ball valve. At this time, the core barrel is located in the pressure-retaining area above the ball valve, so that the coring sample in the core barrel is in a pressure-retaining state, realizing the pressure-retaining sampling of the corer, and improving the coring success rate.

In addition, the pressure-retaining ball valve closing sealing mechanism for realizing the ball valve to flip by 90° is realized by the spring and the ball valve drive sleeve, so that the structure of the pressure-retaining ball valve closing sealing mechanism is greatly simplified, and the operation is more convenient and the reliability is greatly improved and the subsequent maintenance is also more convenient and convenient.

The core sample coring is performed by the cooperation of the coring bit and the cutting shoe, and the double coring bit coring method enables the present invention to adapt to the quaternary sedimentary formation and bedrock, and has a wider application range.

Through the mutual cooperation of the latch mechanism and the latch suspension mechanism, the axial fixation of the core barrel and the single-action effect of the core barrel are realized before retrieved by wireline, that is, the rotary coring is realized, which is simple and quick.

By providing a shearing copper pin protection sleeve on the outer side of the shearing copper pin, the shorter portions of the cut-off shear copper pin always remain in the latch bracket tube inclined portion without falling into the inner tube assembly a, which effectively prevents the occurrence of jamming in the coring process.

BRIEF DESCRIPTION OF THE DRAWINGS

FIGS. 2 to 5 are schematic diagrams showing the segment structure of FIG. 1, the lower end of FIG. 2 is connected to the upper end of FIG. 3, the lower end of FIG. 3 is connected to the upper end of FIG. 4, and the lower end of FIG. 4 is connected to the upper end of FIG. 5.

FIG. 8 is a schematic structural view of an inner tube assembly a;

Figure 1:
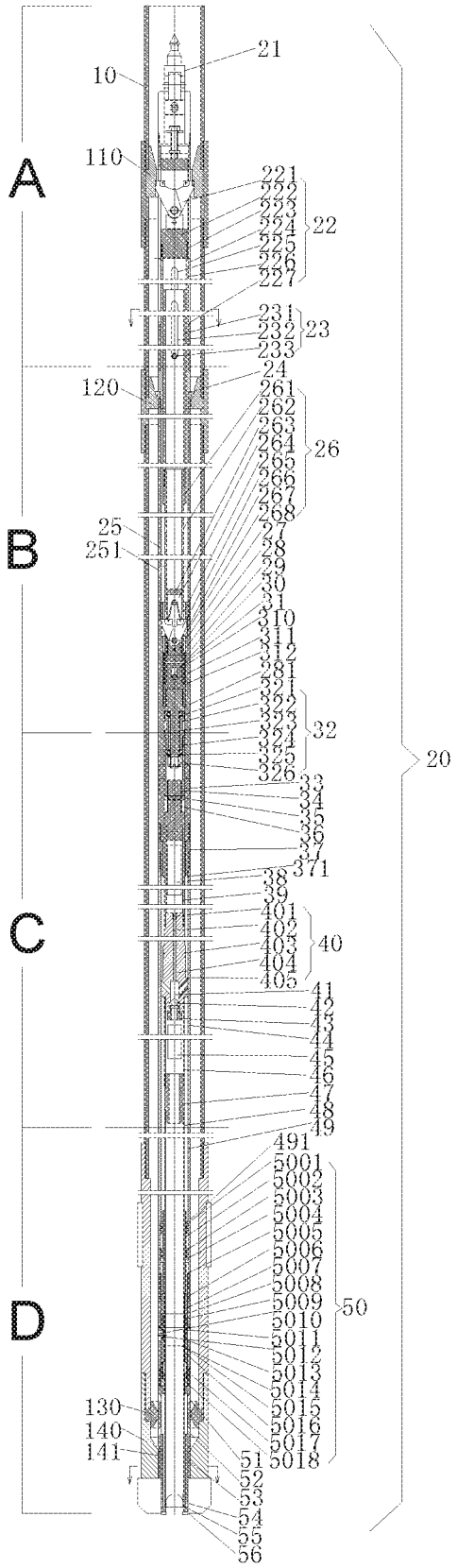
FIG. 1 is a schematic view of the overall structure of the present invention.
Figure 2:
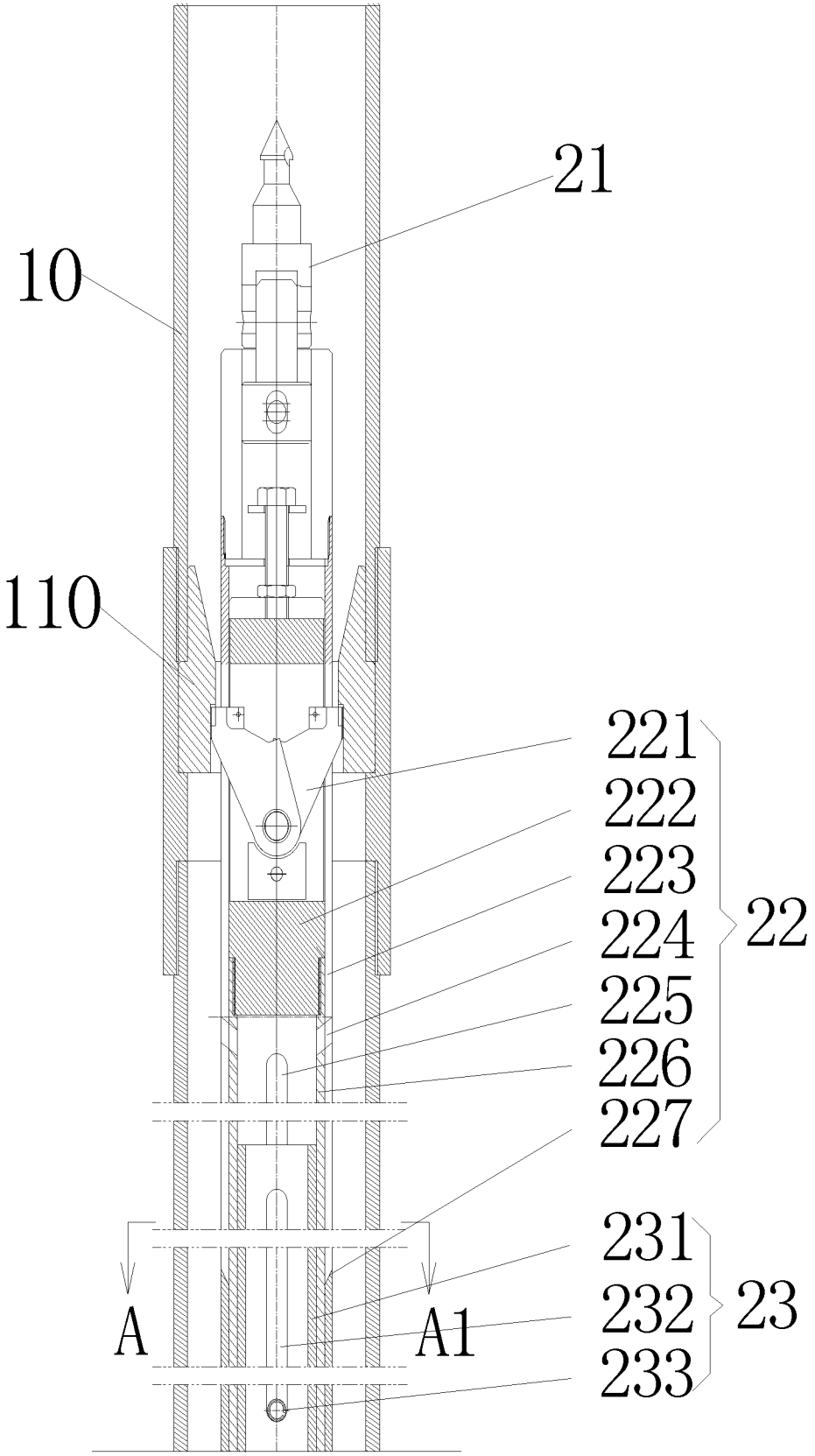
FIG. 2 is an enlarged schematic view of a segment A of FIG. 1.
Figure 3:
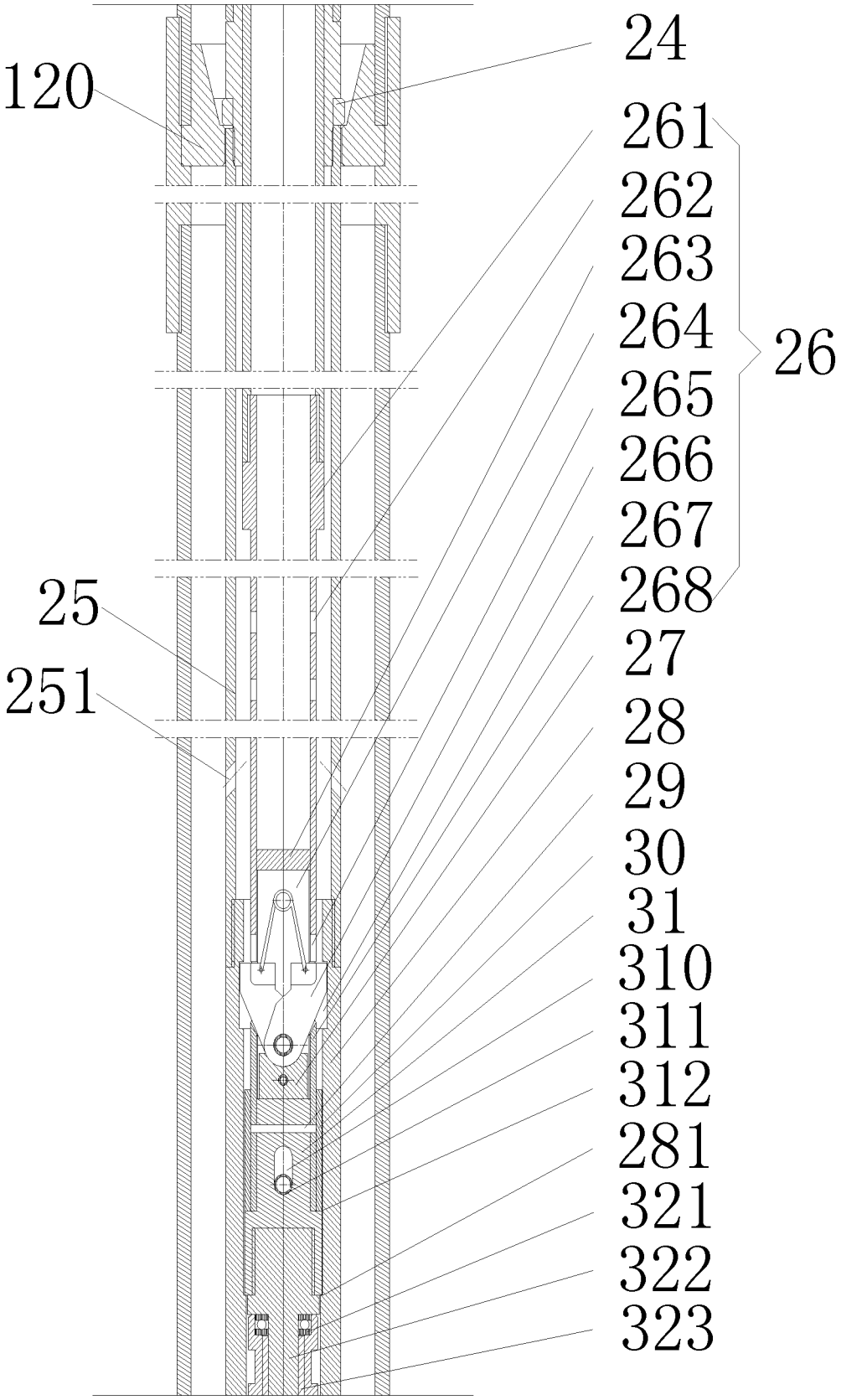
FIG. 3 is an enlarged schematic view of a segment B of FIG. 1.
Figure 4:
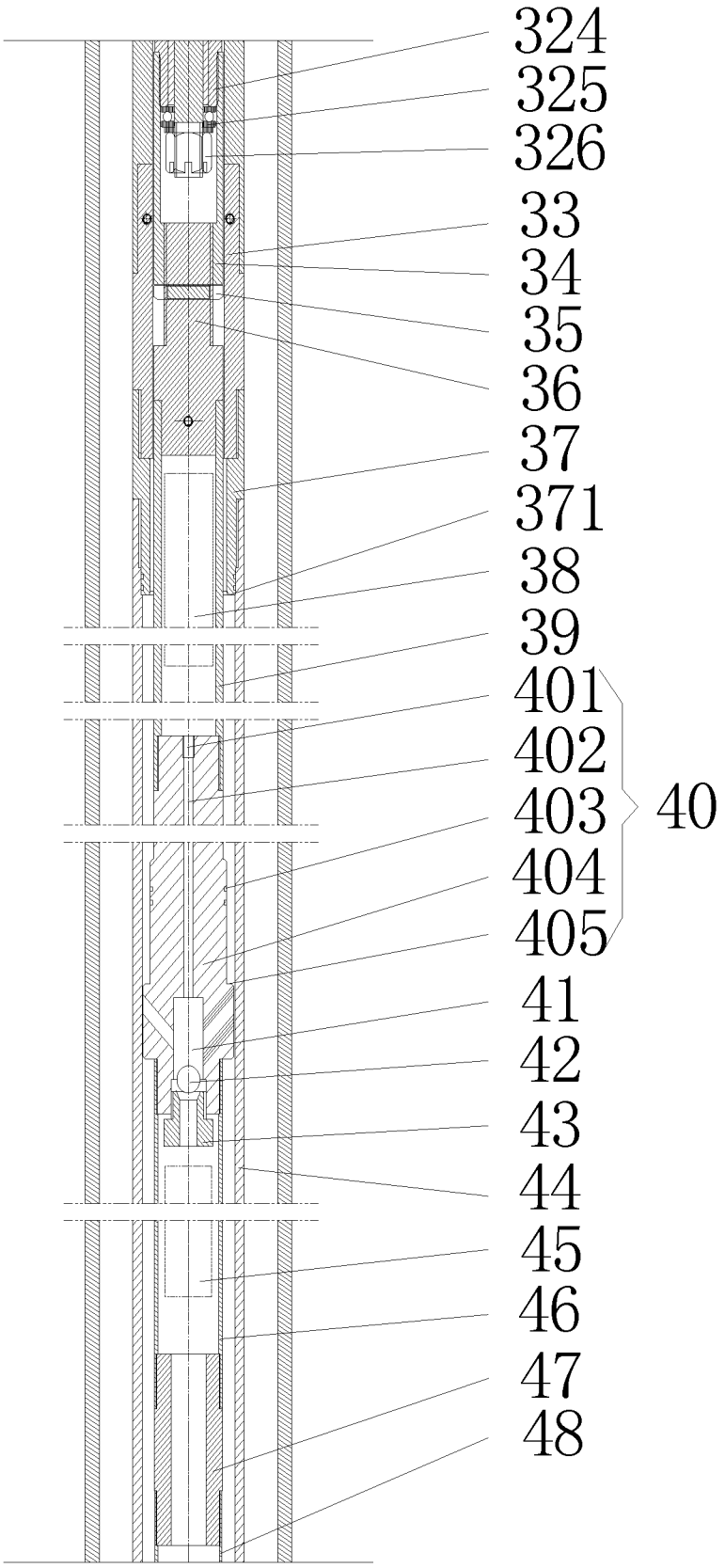
FIG. 4 is an enlarged schematic view of a segment C of FIG. 1.

In the figure, 10—outer tube assembly, 20—inner tube assembly, 201—inner tube assembly a, 202—inner tube assembly b, 110—latch chamber, 120—landing ring, 130—inner-tube stabilizer, 140—outer tube coring bit, 141—torque transfer shoulder, 21—spearhead, 22—latch mechanism, 221—latch a, 222—latch bracket a, 223—latch releasing tube, 224—inlet, 225—latch bracket tube long pin hole, 226—latch bracket tube a, 227—latch releasing tube inclined portion, 23—lifting device, 231—pulling tube, 232—pulling tube long pin hole, 233—spirol pin, 24—suspension ring, 25—long tube, 250—long tube outlet, 26—latch suspension mechanism, 261—latch bracket tube b, 262—latch bracket tube outlet, 263—latch bracket b, 264—latch chamber, 265—latch sheet opening, 266—latch b, 267—latch chamber, 268—latch bracket tube inclined portion, 27—base block, 28—middle tube sub, 281—middle tube sub shoulder, 29—shear copper pin, 30—shear copper pin protection sleeve, 31—spirol pin sub, 310—spirol pin oblong hole, 311—second spirol pin, 312—seat shoulder, 32—single-action mechanism, 321—upper thrust bearing, 322—mandrel, 323—copper sleeve, 324—bearing sleeve, 325—lower thrust bearing, 326—lock nut, 33—short joint, 34—dapter, 35—adjustment mechanism lock nut, 36—adjustment joint, 37—sealing sub, 371—sealing sub shoulder, 38—accumulator, 39—connecting tube, 40—sealing mechanism, 401—quick-plug check valve pressure measurement joint, 402—pressure passage, 403—sealing joint sealing ring, 404—sealing joint, 405—sealing joint shoulder, 41—ball non-return valve chamber, 42—ball non-return valve, 43—ball valve seat, 44—connecting tube, 45—temperature and pressure test chamber, 46—connecting long tube, 47—connecting long tube sub, 48—core barrel, 49—middle tube, 491—middle tube shoulder, 50—pressure-retaining ball valve closing sealing mechanism, 5001—spring limit ring, 5002—ball valve drive sleeve, 5003—spring, 5004—ball valve drive sleeve spring shoulder, 5005—ball valve sub shoulder, 5006—upper ball valve seat sealing ring, 5007—upper ball valve seat, 5008—ball valve sub, 5009—ball valve, 5010—ball valve closing drive pin, 5011—ball valve shaft, 5012—ball valve closing sliding groove, 5013—ball valve sub oblong hole, 5014—ball valve sub window, 5015—lower ball valve seat, 5016—low ball valve seat sealing ring, 5017—bearing spring, 5018—ball valve lower gland, 51—flushing inlet, 52—flushing outlet, 53—torque transfer spline, 54—outlet, 55—basket core catcher, 56—cutting shoe.

DETAILED DESCRIPTION

The present invention will be further described below in conjunction with the drawings and specific embodiments.

As shown in FIGS. 1 to 21, a natural gas hydrate rotary pressure-retaining corer includes an outer tube assembly 10 and an inner tube assembly 20 mounted inside the outer tube assembly 10. There is a latch chamber 110, a landing ring 120 and a inner-tube stabilizer 130 on the inner wall of the outer tube assembly 10 from top to bottom. The bottom end of the outer tube assembly 10 is provided with a coring bit 140.

The inner tube assembly 20 includes an inner tube assembly a 201 and an inner tube assembly b 202. The inner tube assembly b 202 is mounted inside the inner tube assembly a 201 and is movable axially along the inner tube assembly a 201. The inner tube assembly a 201 includes a spearhead 21, a latch mechanism 22, a long tube 25, a middle tube sub 28, a short joint 33, a sealing sub 37, a connecting tube 44, a middle tube 49 and a pressure-retaining ball valve closing sealing mechanism 50 connected sequentially from top to bottom. The inner tube assembly b 202 includes a lifting device 23, a latch suspension mechanism 26, an spirol pin sub 31, a single-action mechanism 32, a dapter 34, an adjustment joint 36, a connecting tube 39, a sealing mechanism 40, a connecting long tube 46, a connecting long tube sub 47 and a core barrel 48 which are sequentially connected from top to bottom.

The spearhead 21, the latch mechanism 22, the long tube 25, the middle tube sub 28, the short joint 33, the sealing sub 37, the connecting tube 44, the middle tube 49, and the ball valve sub 5008 on the pressure-retaining ball valve closing sealing mechanism 50 all adopt a threaded connection or an integral structure. The lifting device 23 and the latch suspension mechanism 26, and the spirol pin sub 31, the single-action mechanism 32, the dapter 34, the adjustment joint 36, the connecting tube 39, the sealing mechanism 40, the connecting long tube 46, the connecting long tube sub 47 and the core barrel 48 all adopt a threaded connection, an integral structure or other fixed connection manner, such as stable snapping, fastening, welding and the like;

The sub outer wall (not shown) of the cutting shoe 56 is in contact with the inner wall of the inner-tube stabilizer 130, preferably in sealing contact, and the drilling fluid cannot pass through.

The latch mechanism 22 includes a latch a 221, a latch bracket a 222, a latch releasing tube 223, an inlet 224, a latch bracket tube long pin hole 225, a latch bracket tube a 226, and a latch releasing tube inclined portion 227. The latch a 221 is disposed in the latch chamber 110 and is connected to the latch bracket a 222. The latch bracket a 222 is connected inside the latch releasing tube 223. The latch releasing tube 223 is fixedly connected to the spearhead 21. The bottom end of the latch releasing tube 223 is provided with the latch releasing tube inclined portion 227 for removing the latch 221 from the latch chamber 110. The side wall of the latch releasing tube 223 is provided with the inlet 224. The latch bracket tube long pin hole 225 is disposed inside the middle cavity of the latch bracket tube a 226.

The lifting device 23 includes a pulling tube 231, a pulling tube long pin hole 232 and a first spirol pin 233. The pulling tube long pin hole 232 is disposed inside the pulling tube 231.

The first spirol pin 233 disposed in the inner tube assembly a 201 is fixedly disposed on the latch releasing tube 223 after passing through the latch bracket tube long pin hole 225 and the pulling tube long pin hole 232. Since the central axes of the latch bracket tube long pin hole 225 and the pulling tube long pin hole 232 are on the same straight line, the first spirol pin 233 can slide freely in the latch bracket tube long pin hole 225 and the pulling tube long pin hole 232 simultaneously, realizing the sleeve connection among the pulling tube 231, the latch bracket tube a 226 and the latch releasing tube 223, thereby realizing the connection of the lifting device 23 and the latch mechanism 22.

The upper portion of the pulling tube 231 is disposed inside the latch bracket tube a 226 and is axially movable along the latch bracket tube a 226. The lower portion is disposed inside the long tube 25. The top end of the pulling tube 231 is located below the latch bracket tube pin hole 225.

The long tube 25 is provided with an inclined long tube outlet 250. The upper end of the long tube 25 is connected to the lower end of the latch bracket tube a 226. The lower end of the long tube 25 is connected to the upper end of the middle tube sub 28. A middle tube sub shoulder 281 is provided on the middle tube sub 28.

A suspension ring 24 is disposed at a joint of the latch bracket tube a 226 and the long tube 25. The suspension ring 24 is seated on the landing ring 120. The inner tube assembly 20 is mounted inside the outer tube assembly 10 in a suspending manner through the suspension ring 24. That is, the weight of the entire inner tube assembly 20 falls on the outer tube assembly 10.

The latch suspension mechanism 26 includes a latch bracket tube b 261, a latch bracket tube outlet 262, a latch bracket b 263, a latch chamber 264, a latch sheet opening 265, a latch b 266, a latch chamber 267, a latch bracket tube inclined portion 268 and a shearing copper pin 29.

The upper portion of the latch suspension mechanism 26 is disposed inside the long tube 25. The lower portion is disposed inside the middle tube sub 28.

The latch bracket tube b 261 is disposed inside the long tube 25. The upper end of the latch bracket tube b 261 is connected to the lower end of the pulling tube 231. The lower end of the latch bracket tube b 261 is provided with the latch bracket tube inclined portion 268 for removing the latch b 266 from the latch chamber 267. The latch bracket tube inclined portion 268 is disposed inside the middle tube sub 28. The latch sheet opening 265 is provided between the latch bracket tube inclined portion 268 and the latch bracket tubes b 261. A plurality of latch bracket tube outlets 262 are arranged in an array on the latch bracket tube b 261. The latch bracket tube outlet 262 is located above the latch bracket b 263. The latch bracket b 263 is disposed laterally inside the latch bracket tube outlet 262. The latch chamber 264 is disposed below the latch bracket b 263. Two latches b 266 are provided below the latch chamber 264. The upper ends of the two latches b 266 are fixed on the latch chamber 264 by a connecting member (not shown). The two latches b 266 are located in the latch chamber 267. The latch chamber 267 is located inside the middle tube sub 28. The lower end of the latch b 266 is disposed on the underneath base block 27. The base block 27 is disposed inside the middle tube sub 28. The latch b 266 is held by the shoulder of the middle tube sub 28 (not shown) after opening for a certain angle so that the latch b 266 cannot move upward axially. That is, the latch suspension mechanism 26 is held by the shoulder of the middle tube sub 28 and cannot move upward axially.

In the present embodiment, all "upward" refers to the upward direction toward the spearhead 21, and "downward" refers to the downward direction from the spearhead 21.

Below the base block 27, there is provided the spirol pin sub 31. The upper portion of the spirol pin sub 31 is located inside the latch bracket tube inclined portion 268. The shearing copper pin 29 is disposed at the upper portion of the spirol pin sub 31. The shearing copper pin 29 passes transversely through the upper portion of the spirol pin sub 31. Two ends of the shearing copper pin 29 protrude into the interior of the latch bracket tube inclined portion 268. The shearing copper pin protection sleeve 30 is disposed between the latch bracket tube inclined portion 268 and the middle tube sub 28. The outer wall of the latch tube inclined portion 268 and the end of the shearing copper pin 29 are attached to the inner wall of the shearing copper pin protection sleeve 30. That is, the shearing copper pin 29 does not protrude into the shearing copper pin protection sleeve 30. The outer wall of the shearing copper pin protection sleeve 30 is attached to the inner wall of the middle tube sub 28.

In this embodiment, the spirol pin sub 31 and the latch bracket b263 are an integral structure.

The spirol pin sub 31 is provided with an axially disposed spirol pin oblong hole 310. The spirol pin oblong hole 310 is provided with the second spirol pin 311. The second spirol pin 311 is fixedly disposed on the latch bracket tube inclined portion 268 after passing through the spirol pin oblong hole 310 and the spirol pin sub 31. The second spirol pin 311 is slidable in the spirol pin oblong hole 310.

The latch bracket tube inclined portion 268 and the shear copper pin protection sleeve 30 are both seated on the seat shoulder 312 of the spirol pin sub 31 so that the latch bracket tube inclined portion 268 can move upward axially with respect to the spirol pin sub 31.

The lower portion of the spirol pin sub 31 is located inside the middle tube sub 28 and is seated on the middle tube sub shoulder 281 of the middle tube sub 28 such that the spirol pin sub 31 is held by the middle tube sub 28 and cannot move axially downward, and thus the latch suspension mechanism 26 cannot move axially downward.

The interior of the middle tube sub 28 is further provided with the single-action mechanism 32. The single-action mechanism 32 is located below the spirol pin sub 31.

The single-action mechanism 32 includes an upper thrust bearing 321, a mandrel 322, a copper sleeve 323, a bearing sleeve 324, a lower thrust bearing 325, and a lock nut 326. The upper end of the mandrel 322 is screwed to the bottom end of the spirol pin sub 31. The bearing sleeve 324 is sleeved on the mandrel 322. The copper sleeve 323 is disposed between the bearing sleeve 324 and the mandrel 322. The upper and lower ends of the copper sleeve 323 are respectively provided with the upper thrust bearing 321 and the lower thrust bearing 325. The bottom end of the mandrel 322 is provided with the lock nut 326. The lower thrust bearing 325 is located above the lock nut 326.

The single-action mechanism 32 is connected to the dapter 34 via the bearing sleeve 324. The dapter 34 is connected to the upper end of the adjustment joint 36. The adjustment joint 36 is sleeved with an adjustment mechanism lock nut 35. The adjustment mechanism lock nut 35 is disposed at the lower end of the dapter 34. The adjustment joint 36 is located at the inner wall of the short joint 33. The lower end of the adjustment joint 36 is connected to the upper end of the connecting tube 39. The lower end of the connecting tube 39 is connected to the sealing mechanism 40.

The upper portion of the short joint 33 is connected to the middle tube sub 28, and the lower portion is connected to the upper end of the sealing sub 37. The lower end of the sealing short portion 37 is connected to the upper end of the connecting tube 44.

The single-action mechanism 32 prevents the core barrel 48 from rotating along with the outer tube assembly 10 to cause core wear.

The sealing mechanism 40 includes a quick-plug check valve pressure measuring joint 401, a pressure passage 402, a sealing joint sealing ring 403, a sealing joint 404, and a sealing joint shoulder 405.

The upper end of the sealing joint 404 is connected to the lower end of the connecting tube 39. The middle portion of the sealing joint 404 is provided with the axial pressure passage 402. The quick-plug check valve pressure measuring joint 401 protrudes into the pressure passage 402. The sealing joint 404 is sleeved with the sealing joint sealing ring 403. The sealing joint shoulder 405 is arranged on both sides of the sealing joint 404. The lower end of the sealing joint 404 is connected to the upper end of the connecting long tube 46, preferably a threaded connection.

The sealing mechanism 40 is located inside the connecting tube 44 and can move axially along the connecting tube 44. When the sealing mechanism 40 reaches the upward limit position, the sealing joint shoulder 405 contacts the sealing sub 37, and the sealing mechanism 40 stops moving upward. When the sealing mechanism 40 reaches the downward limit position, the adjustment joint 36 contacts the connecting tube 39, and the sealing mechanism 40 stops moving downward.

A ball non-return valve 42 is connected below the sealing mechanism 40. The ball non-return valve 42 is disposed in the ball non-return valve chamber 41. The ball non-return valve chamber 41 is disposed inside the sealing joint 404. The ball non-return valve 42 is disposed so that the air flow can only flow into the pressure passage 402 of the sealing mechanism 40 through the ball non-return valve 42 from down to up.

The lower end of the ball non-return valve 42 is disposed on the ball valve seat 43. The ball valve seat 43 is provided with an axial passage. The ball valve seat 43 is fixedly connected to the sealing joint 404. The ball valve seat 43 is located in the connecting long tube 46.

The lower end of the connecting long tube 46 is connected to the upper end of the connecting long tube sub 47. The lower end of the connecting long tube sub 47 is fixedly connected to the upper end of the core barrel 48, preferably a threaded connection. The lower end of the core barrel 48 is connected to a basket core catcher 55 for obtaining and fixing of the core sample. The core barrel 48 is located inside the middle tube 49.

The pressure-retaining ball valve closing sealing mechanism 50 includes a spring limit ring 5001, a ball valve drive sleeve 5002, a spring 5003, a ball valve drive sleeve spring shoulder 5004, a ball valve sub shoulder 5005, an upper ball valve seat sealing ring 5006, an upper ball valve seat 5007, a ball valve sub 5008, a ball valve 5009, a ball valve closing drive pin 5010, a ball valve shaft 5011, a ball valve closing sliding groove 5012, a ball valve sub oblong hole 5013, a ball valve sub window 5014, a lower ball valve seat 5015, a lower ball valve seat sealing ring 5016, a load-bearing spring 5017 and a ball valve lower gland 5018. The ball valve 5009 is provided with the ball valve shaft 5011 and the ball valve closing sliding groove 5012. The ball valve 5009 is provided with a through hole for the core barrel 48 to pass through.

The ball valve sub 5008 on the inner tube assembly a 201 is provided with a ball valve sub sealing ring (not shown), the ball valve closing drive pin 5010 and the ball valve sub oblong hole 5013 from top to bottom.

The upper end of the ball valve sub 5008 is connected to the lower end of the middle tube 49. Preferably, the upper end of the ball valve sub 5008 is connected to the lower end of the middle tube 49 by a threaded connection. The ball valve sub sealing ring is disposed at the joint of the ball valve sub 5008 and the middle tube 49. The hollow interior of the ball valve sub 5008 is provided with the ball valve sub window 5014. The middle portion of the ball valve sub 5008 is provided with the ball valve sub oblong hole 5013. The ball valve closing drive pin 5010 located in the ball valve sub oblong hole 5013 is fixed on the inner wall of the ball valve sub 5008. The ball valve closing drive pin 5010 protrudes into the ball valve closing sliding groove 5012 of the ball valve 5009.

The ball valve 5009 is fixedly disposed in the ball valve sub window 5014 of the ball valve sub 5008 through the ball valve shaft 5011. One end of the ball valve shaft 5011 is connected to the ball valve 5009, and the other end protrudes into the ball valve sub oblong hole 5013, and can freely slide axially in the ball valve sub oblong hole 5013.

The ball valve sub 5008 is internally provided with the upper ball valve seat 5007 and the lower ball valve seat 5015. The attachment between the ball valve sub 5008 and the upper ball valve seat 5007 is provided with the upper ball valve seat sealing ring 5006. The attachment between the ball valve sub 5008 and the lower ball valve seat 5015 is provided with the lower ball valve seat sealing ring 5016. The upper ball valve seat sealing ring 5006 is disposed in the inner wall gap of the upper ball valve seat 5007 and the ball valve sub 5008, so that a sealing contact is formed between the upper ball valve seat 5007 and the ball valve sub 5008. Similarly, the lower ball valve seat sealing ring 5016 is disposed in the inner wall gap of the lower ball valve seat 5015 and the ball valve sub 5008, so that the lower ball valve seat 5015 forms a sealing contact with the ball valve sub 5008. The upper end of the ball valve sub 5008 is provided with the ball valve sub shoulder 5005. The middle portion of the ball valve sub 5008 is in contact with the middle tube 49 by concave-convex fitting and holds the middle tube 49, and the lower portion of the ball valve sub 5008 is connected to the middle tube 49, preferably a threaded connection, to ensure that the connection between the middle tube 49 and the ball valve sub 5008 is more secure.

The upper end of the upper ball valve seat 5007 is connected to the lower end of the ball valve drive sleeve 5002, and the lower end is in contact with the upper end of the ball valve 5009. The ball valve drive sleeve 5002 is located below the connecting long tube sub 47. The ball valve drive sleeve 5002 is located between the core barrel 48 and the middle tube 49. The spring 5003 is further disposed between the ball valve drive sleeve 5002 and the middle tube 49. The spring 5003 is sleeved on the ball valve drive sleeve 5002. The upper end of the spring 5003 is in contact with the spring limit ring 5001 and is pressed by the spring limit ring 5001. That is, the upper limit position of the spring 5003 after opening is restricted by the spring limit ring 5001. The spring limit ring 5001 is restrained by the middle tube shoulder 491 by concave-convex fitting. Then the spring limit ring 5001 is compressed by the spring limit ring 5001. The spring limit ring 5001 is located between the core barrel 48 and the middle tube 49. The lower end of the spring limit ring 5001 is in contact with the ball valve drive sleeve spring shoulder 5004 and is held by the ball valve drive sleeve spring shoulder 5004. The ball valve drive sleeve spring shoulder 5004 is in contact with the spring limit ring 5001 and holds the spring limit ring 5001. The ball valve drive sleeve spring shoulder 5004 can be an outer protruding block of the ball valve drive sleeve 5002 or a stopper fixedly connected to the ball valve drive sleeve 5002. The ball valve drive sleeve spring shoulder 5004 is located above the ball valve shoulder 5005.

By placing the spring 5003 between the spring limit ring 5001 and the ball valve drive sleeve spring shoulder 5004, the spring 5003 is in a compressed state. The ball valve sub shoulder 5005 is located between the ball valve drive sleeve 5002 and the middle tube 49, and above the upper ball valve seat 5007.

The lower ball valve seat 5015 is provided with the load-bearing spring 5017 and the ball valve lower gland 5018 from top to bottom. The upper and lower ends of the load-bearing spring 5017 are respectively connected to the lower ball valve seat 5015 and the ball valve lower gland 5018. The upper end of the lower ball valve seat 5015 is in contact with the lower end of the ball valve 5009.

The load-bearing spring 5017 realizes floating contact between the ball valve 5009 and the lower ball valve seat 5015.

The upper end of the ball valve sub 5008 is connected to the lower end of the middle tube 49 to realize the connection between the pressure-retaining ball valve closing sealing mechanism 50 and the middle tube 49. The spring 5003 in the compressed state pushes the ball valve 5009 of the pressure-retaining ball valve closing sealing mechanism 50 to slide down and flip by 90° through the ball valve drive sleeve 5002.

Figure 5:
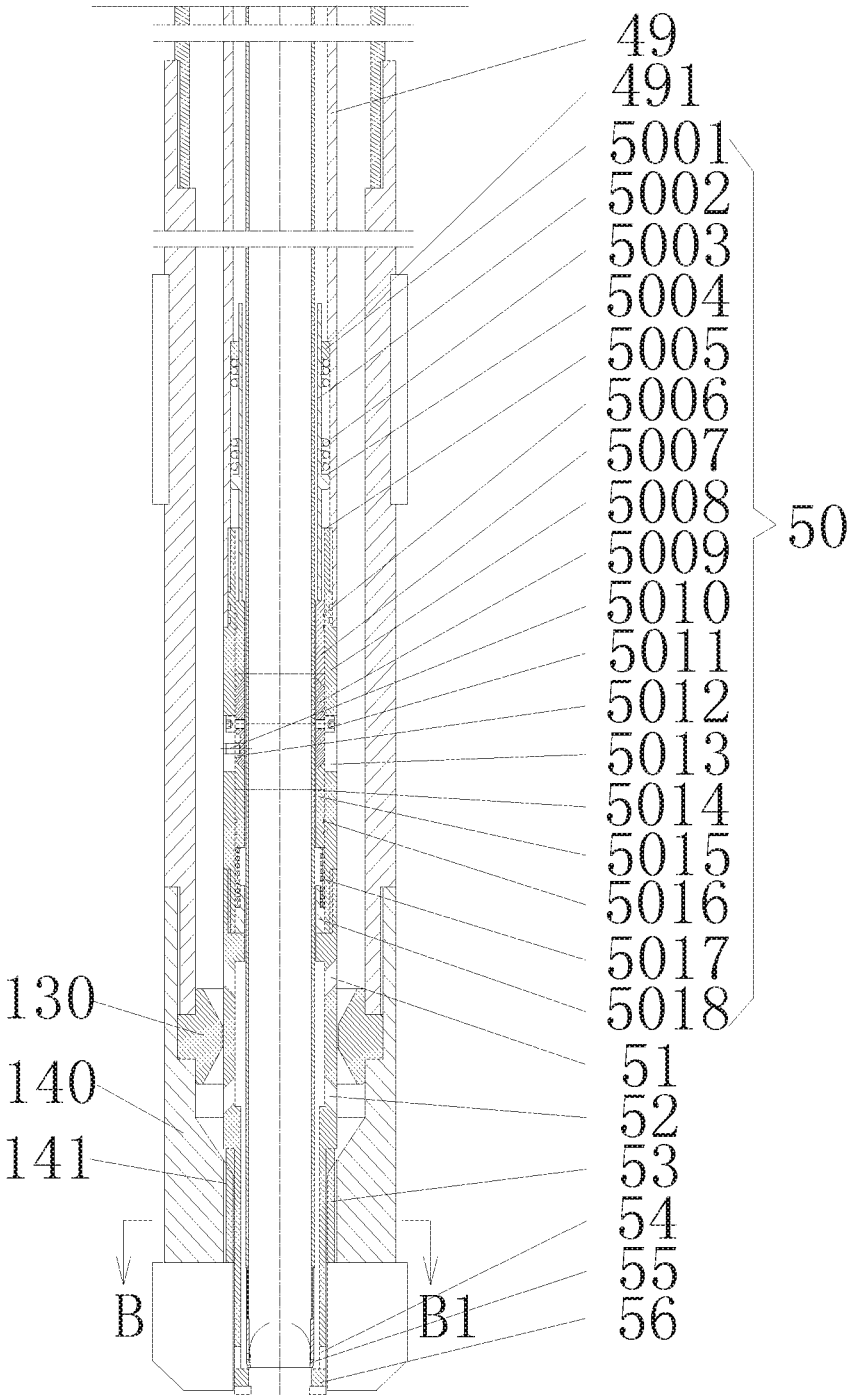
FIG. 5 is an enlarged schematic view of a segment D of FIG. 1.
Figure 6:
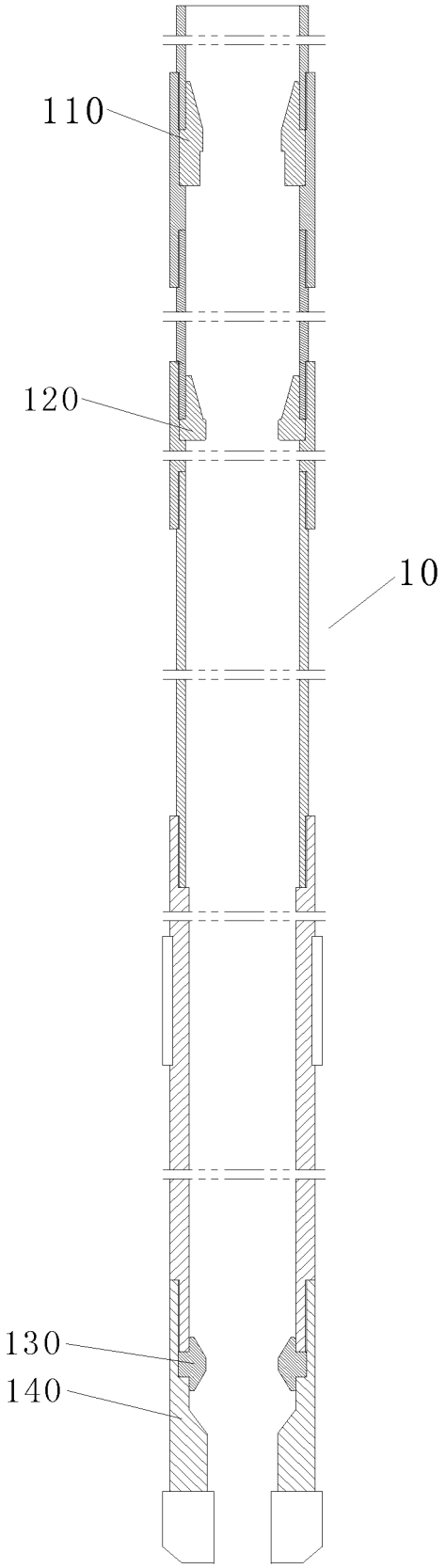
FIG. 6 is a schematic structural view of an outer tube assembly.
Figure 7:
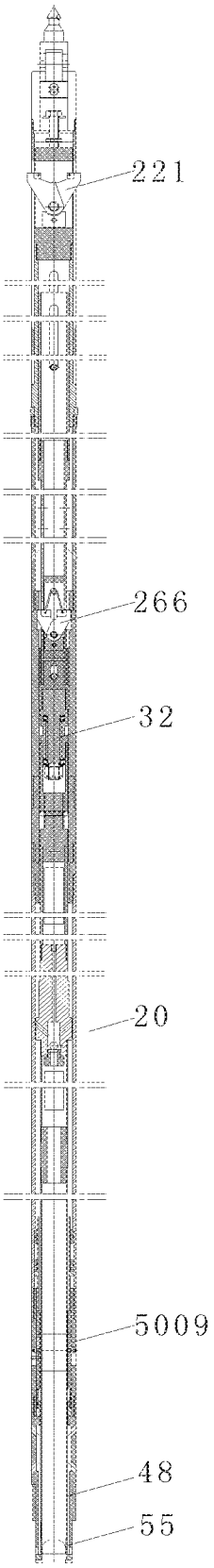
FIG. 7 is a schematic structural view of an inner tube assembly.
Figure 8:
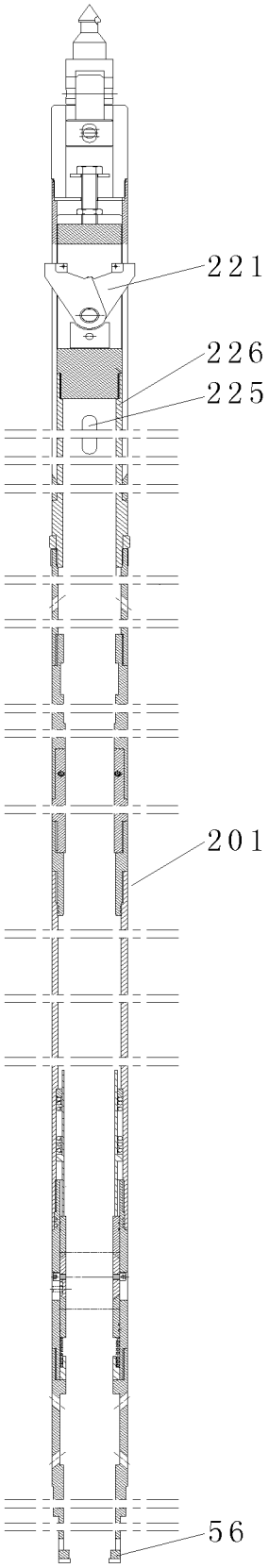
Figure 9:
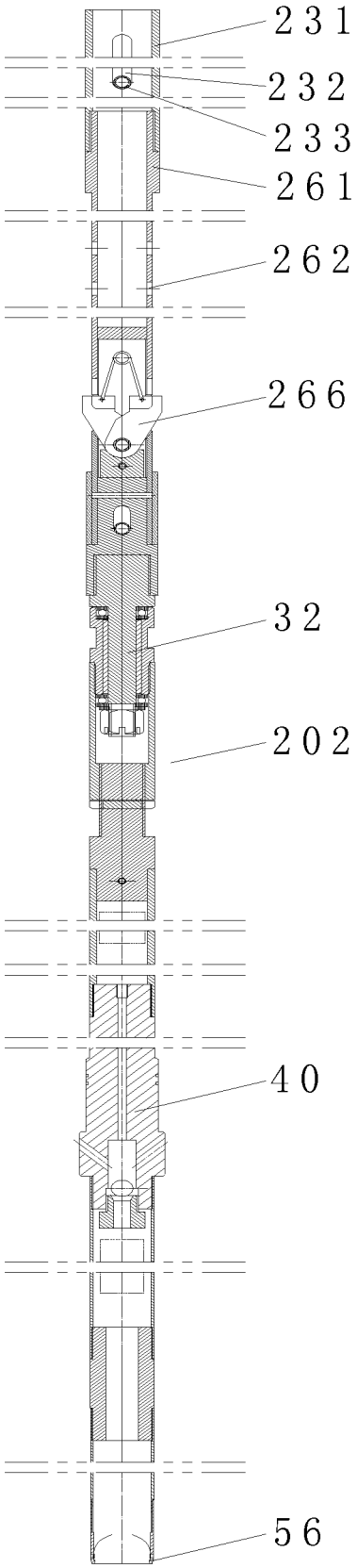
FIG. 9 is a schematic structural view of an inner tube assembly b.
Figure 10:
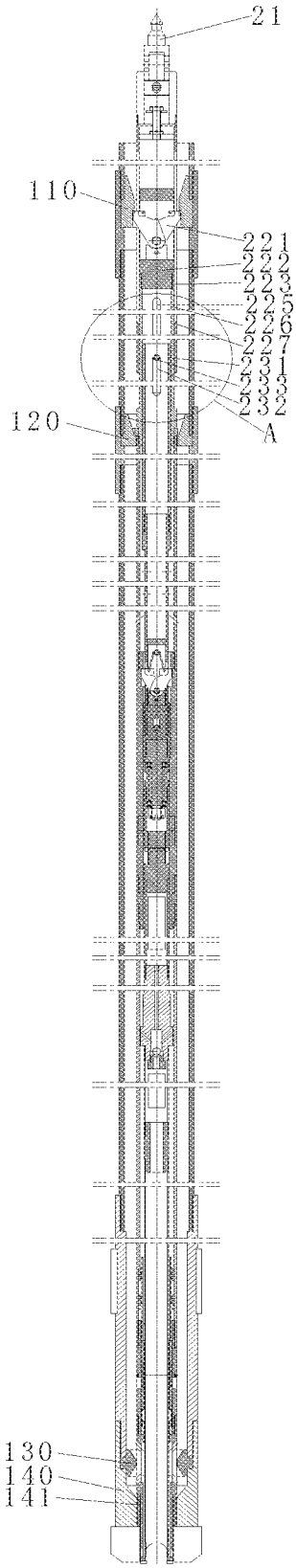
FIG. 10 is a schematic diagram of a state in the process of retrieving by wireline and latch releasing after the coring is completed (the first spirol pin reaches the top end of the pulling tube long pin hole)
Figure 11:
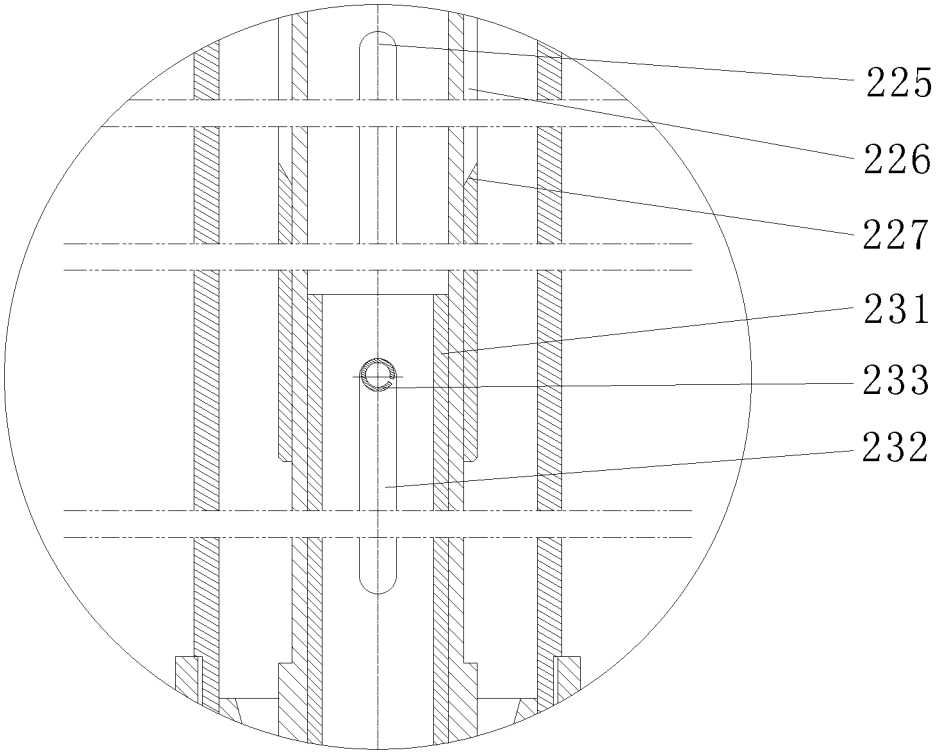
FIG. 11 is an enlarged schematic view of the portion A in FIG. 10.
Figure 12:
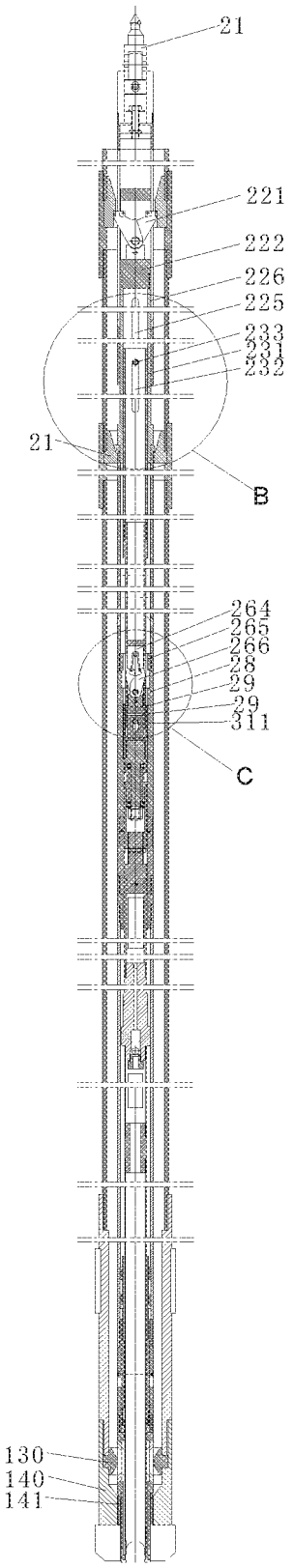
FIG. 12 is a schematic diagram of a state in the process of retrieving by wireline and latch releasing after the completion of the coring (the latch suspension mechanism completes the latch releasing action)
Figure 13:
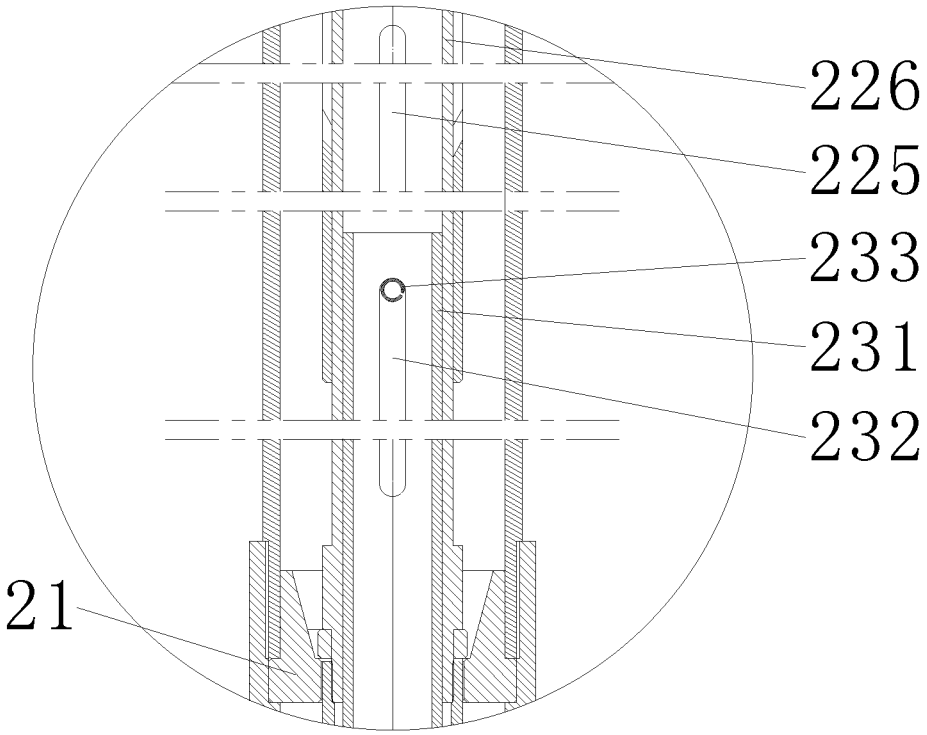
FIG. 13 is an enlarged schematic view of the portion B in FIG. 12.
Figure 14:
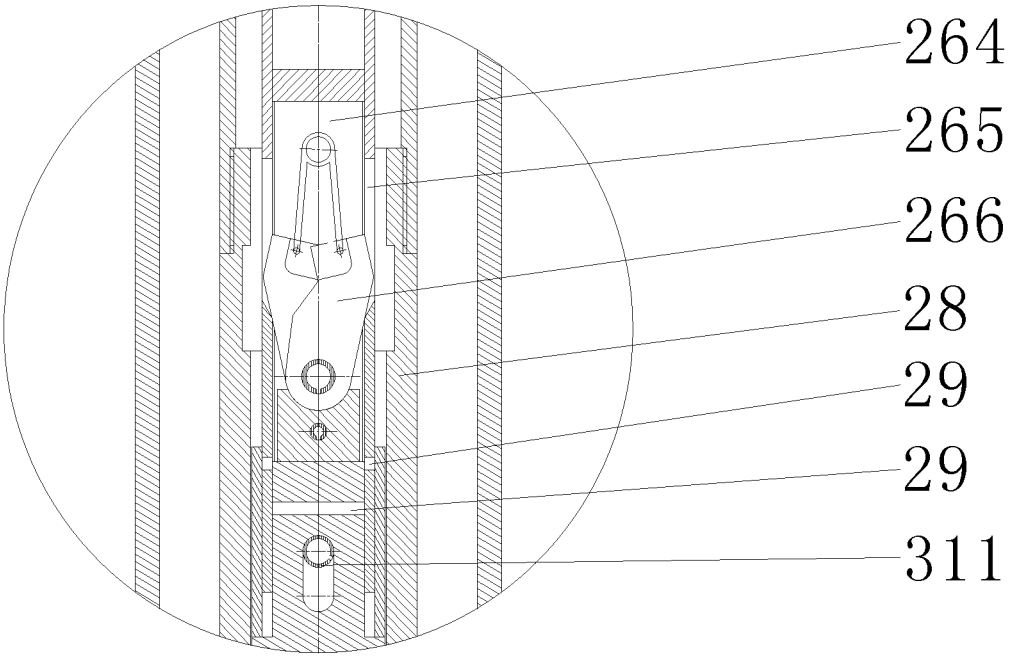
FIG. 14 is an enlarged schematic view of the portion C in FIG. 12.
Figure 15:
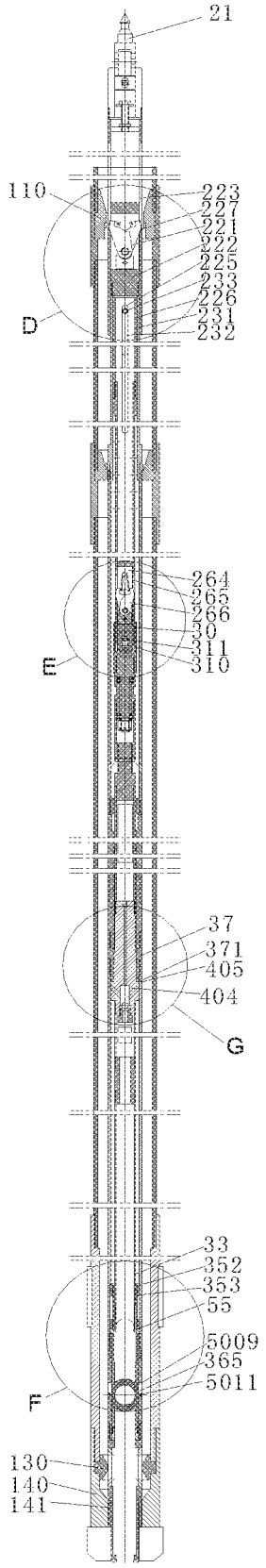
FIG. 15 is a schematic diagram of the state of the ball valve during the process of flipping (the core barrel has been pulled out from the ball valve through hole)
Figure 16:
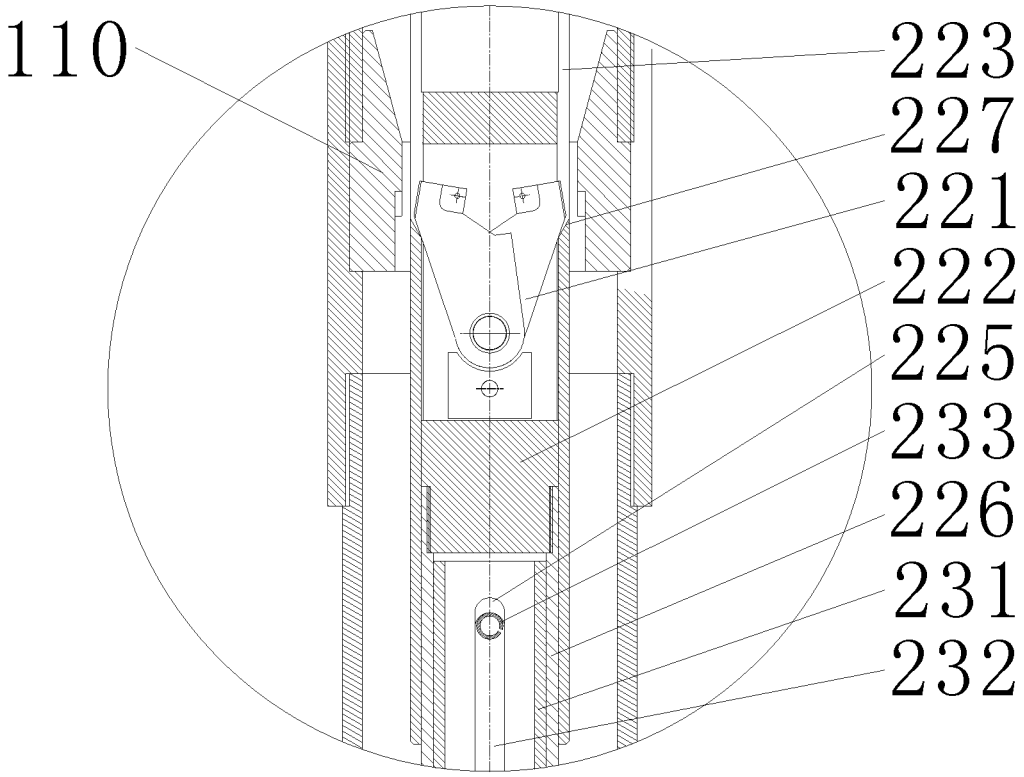
FIG. 16 is an enlarged schematic view of the portion D in FIG. 15.
Figure 17:
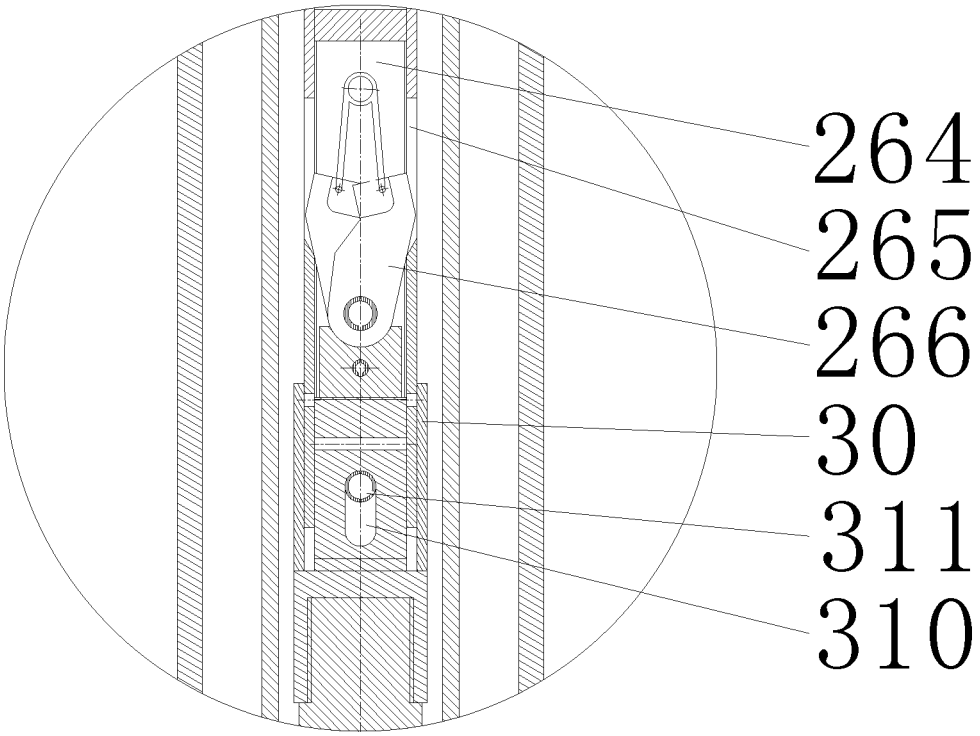
FIG. 17 is an enlarged schematic view of a portion E in FIG. 15.
Figure 18:
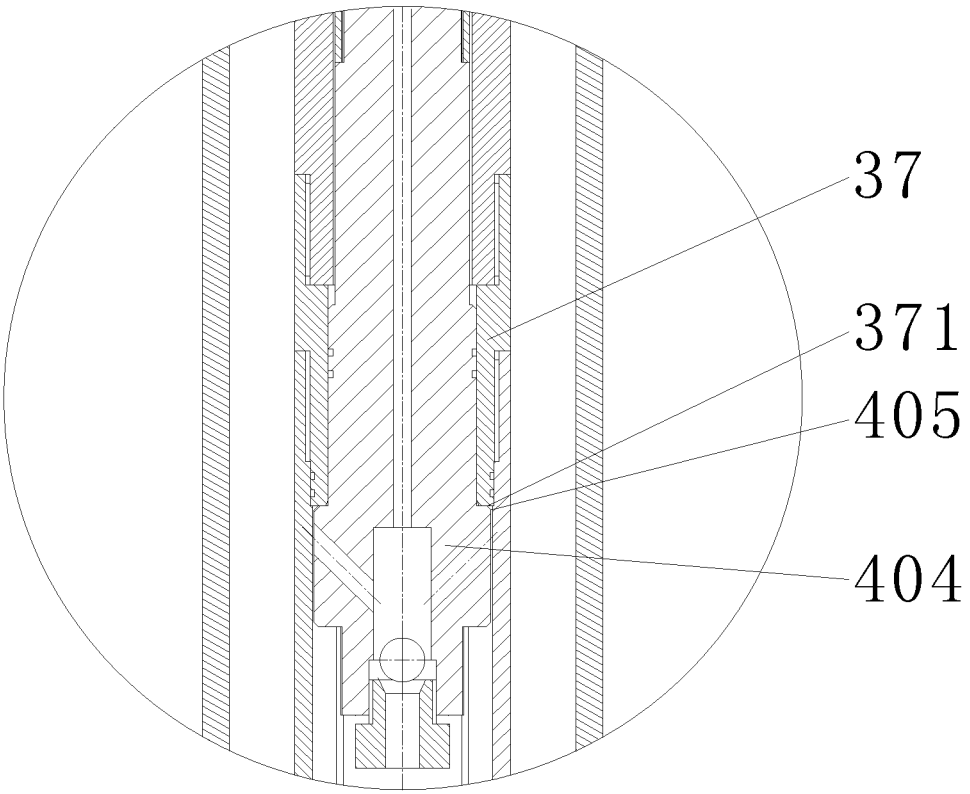
FIG. 18 is an enlarged schematic view of a portion G in FIG. 15.
Figure 19:
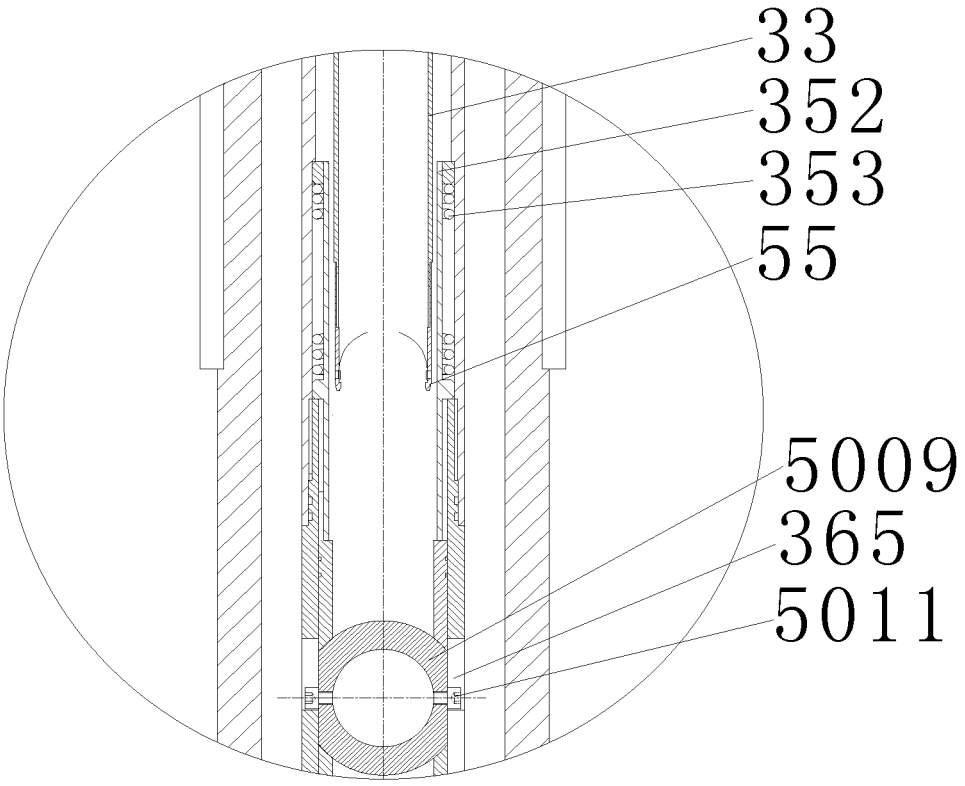
FIG. 19 is an enlarged schematic view of a portion F in FIG. 15.
Figure 20:
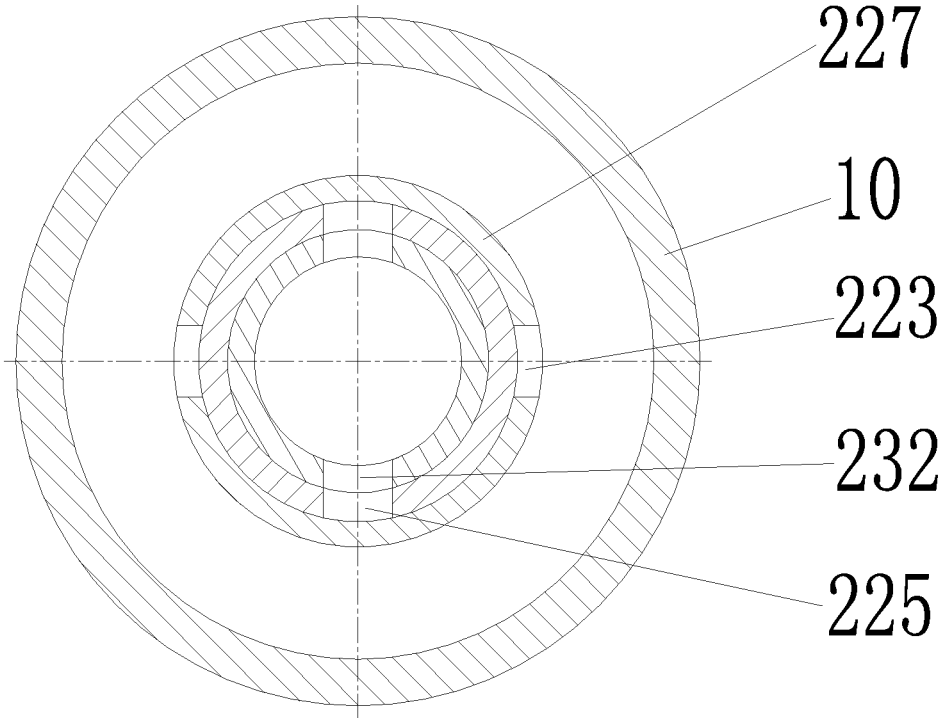
FIG. 20 is a cross-sectional structural view taken along line A-A1 of FIG. 2.
Figure 21:
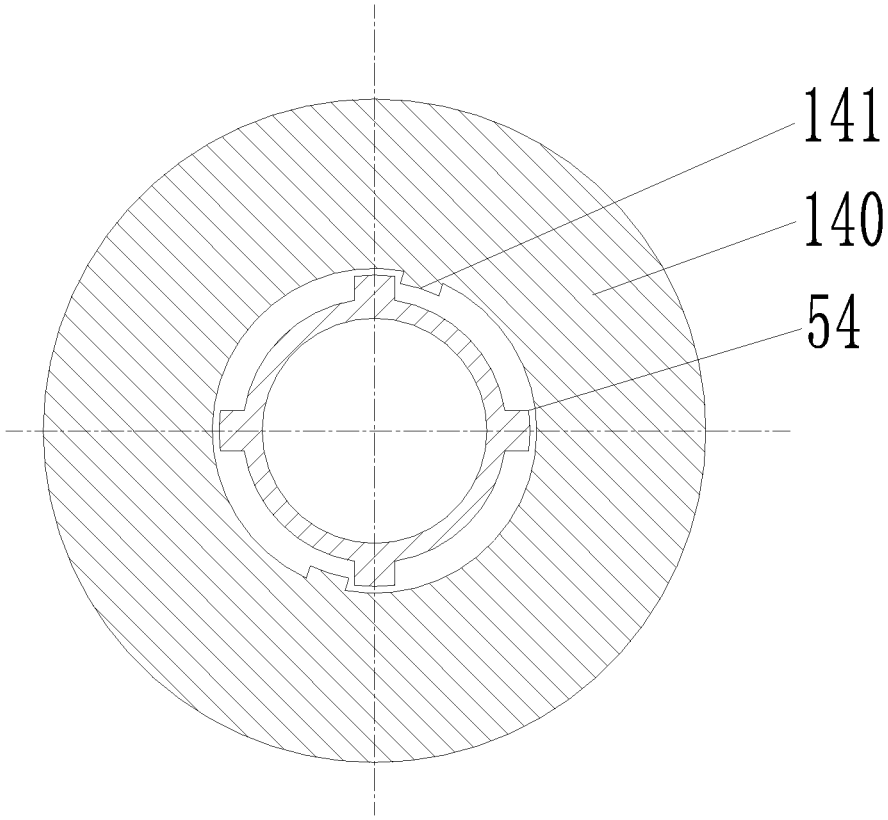
FIG. 21 is a cross-sectional view showing the structure taken along line B-B1 of FIG. 5.

In the specific use, as shown in FIG. 5, before coring and retrieving by wireline, that is, when coring and mounting are performed using the present invention, the core barrel 48 passes downward from the through hole of the ball valve 5009. The core barrel 48 is tightly attached to the ball valve 5009. After the core barrel is installed, since the latch mechanism 22 is restrained in the latch chamber 110 and cannot pass over the latch chamber 110 upward, and the latch suspension mechanism 26 is restricted in the middle tube sub 28 and cannot pass over the middle tube sub 28, such that the inner tube assembly b 202 at this time cannot move axially, and thus the core barrel 48 cannot move axially, that is, maintains axial fixation. The ball valve 5009 suffers from the thrust transmitted by the spring 5003 in a compressed state through the ball valve drive sleeve 5002. Because the ball valve 5009 at this time is closely attached by the core barrel 48, which is equivalent to the situation where a lateral resistance is exerted by the core barrel 48 to the ball valve 5009, the ball valve 5009 does not flip down due to the thrust given by the spring 5003, that is, the core barrel 48 restricts the ball valve 5009 from flipping down. At the same time, the ball valve 5009 is contacted by the core barrel 48, so that the ball valve 5009 holds upward the upper ball valve seat 5007. The upper ball valve seat 5007 moves upward by holding the ball valve drive sleeve 5002 upward. The ball valve drive sleeve spring shoulder 5004 on the ball valve drive sleeve 5002 also moves upward correspondingly, and the spring limit ring 5001 is restrained by the middle tube shoulder 491 on the middle tube 49, thus causing the spring to be compressed and the elastic potential energy to increase. After the coring is completed and retrieving by wireline is performed, as shown in FIG. 15 and FIG. 18, after the core barrel 48 is pulled upward from the through hole of the ball valve 5009, the lateral resistance exerted by the core barrel 48 to the ball valve 5009 disappears, that is, the core barrel 48 does not restrict the ball valve 5009 to flip down. Since the elastic potential energy of the spring is sufficient, the ball valve 5009 moves down as a whole along the ball valve sub oblong hole 5013 under the thrust exerted by the spring 5003. When the ball valve shaft 5011 connected to the ball valve 5009 contacts the ball valve closing drive pin 5010, the thrust generated by the spring 5003 pushes the ball valve closing drive pin 5010. Since the ball valve closing drive pin 5010 is held by the ball valve closing sliding groove 5012 on the ball valve 5009, the ball valve closing drive pin 5010 gives the ball valve 5009 a torque, so that the ball valve 5009 slides down and flips by 90°. During the downward sliding of the ball valve 5009, the ball valve 5009 pushes down the lower ball valve seat 5015. The lower ball valve seat 5015 compresses the load-bearing spring 5017 to move downward until the lower ball valve seat 5015 is in contact with the ball valve lower gland. That is, when the ball valve 5009 reaches the downward limit position, the lower ball valve seat 5015 is in contact with the ball valve lower gland.

Through the above operation, the pressure-retaining ball valve closing sealing mechanism and the core barrel cooperate to realize that the ball valve slides downward and flips by 90°.

The ball valve 5009 is in sealing contact with the upper ball valve seat 5007, which realizes the pressure-retaining effect of the upper area of the ball valve 5009. At this time, the core barrel 48 is located in the pressure-retaining area above the ball valve 5009, so that the coring sample in the core barrel 48 is in a pressure-retaining state, which realizes the pressure-retaining sampling of the coring device.

Further, an accumulation chamber is disposed between the lower portion of the adjustment joint 36 and the upper portion of the sealing mechanism 40. The accumulation chamber is located inside the connecting tube 39. The accumulation chamber is provided with an accumulator 38. The accumulator 38 is connected to the quick-plug check valve pressure measuring joint 401. The accumulator 38 is used to maintain a stable pressure.

Further, a temperature and pressure test chamber 45 is disposed between the lower portion of the ball valve seat 43 and the upper portion of the connecting long tube 47. The temperature and pressure test chamber 45 is located inside the connecting long tube 46. The temperature and pressure test chamber 45 is installed therein with equipment for measuring temperature and pressure parameters.

Further, the lower end of the pressure-retaining ball valve closing sealing mechanism 50 is connected to a flushing mechanism (not shown) for flushing the core barrel 48. The flushing mechanism is mounted on the inner tube assembly a 201. The flushing mechanism avoids contaminants such as cuttings on the core barrel 48 being brought into the corer, especially brought into the pressure-retaining area, which would affect the pressure-retaining effect and may even fail to maintain pressure.

The flushing mechanism includes a flushing inlet 51 and a flushing outlet 52. After the high pressure drilling fluid enters from the flushing inlet 51, the cuttings on the core barrel 48 are subjected to high pressure rapid flushing. The drilling fluid is then discharged from the flushing outlet 52. The mechanism is screwed to the lower end of the ball valve sub 5008 and to the lower end of the ball valve lower gland 5018.

In this embodiment, the flushing mechanism is provided with two outlet passages, which are respectively a first outlet passage formed by the gap between the outer tube coring bit 140 and the cutting shoe 56 and a second outlet passage formed by the gap between the core barrel 48 and the cutting shoe 56. The drilling fluid enters the inner tube assembly b 202 from the inlet 224, then flows out of the latch bracket tube outlet 262, and enters between the inner tube assembly a 201 and the inner tube assembly b 202, and then flows out from the long tube outlet 250 and enters the area between the outer tube assembly 10 and the inner tube assembly 20. Since the inner-tube stabilizer 130 is in sealing contact with the flushing mechanism, the drilling fluid between the outer tube assembly 10 and the inner tube assembly 20 enters the flushing mechanism through the flushing inlet 51. The drilling fluid entering the flushing mechanism from the flushing inlet 51 is discharged in one way from the first outlet passage, that is, discharged from the gap between the outer tube coring bit 140 and the cutting shoe 56, and discharged in the other way from the second outlet passage, that is, discharged from the gap between the core barrel 48 and the cutting shoe 56, which realizes the flushing of the core barrel 48 by the flushing mechanism together.

In this embodiment, the cutting shoe 56 is connected to the flushing mechanism and is located below the flushing mechanism. The cutting shoe 56 is a five-winged carbide scraping bit or a PDC bit or a drill made of other materials. The connection between the cutting shoe 56 and the flushing mechanism, the connection between the flushing mechanism and the ball valve sub 5008, and the connection between the ball valve sub 5008 and the middle tube 49 realizes the connection between the cutting shoe 56 and the middle tube 49 and also the connection between the cutting shoe 56 and the inner tube assembly 20, that is, the tube assembly 20 is capable of driving the cutting shoe 56 to rotate.

In the present embodiment, the outer tube coring bit 140 is provided with an inwardly projecting torque transfer shoulder 141. The torque transfer shoulder 141 is engaged with the outwardly protruding torque transfer spline 53 disposed on the cutting shoe 56. Thus, the outer tube coring bit 140 transmits torque to the cutting shoe 56 and drives the cutting shoe 56 to rotate together with each other, so that the outer tube coring bit 140 cooperates with the cutting shoe 56 to perform core sample coring. The double coring bit is used for coring so that the present invention can adapt to the hard formation and has a wider application range. A certain gap is provided between the basket core catcher 55 and the cutting shoe 56. The inner diameter of the basket core catcher 55 is larger than the inner diameter of the cutting shoe 56, so that during the rotation and coring process, the cutting shoe 56 is swung into the ruler, and the basket core catcher 55 is kept in a single-action without rotating, which is advantageous for the core sample rotated and trimmed by the cutting shoe 56 to enter into the basket core catcher 55 and the core barrel 48.

In the specific use, when the inner tube assembly 20 is successfully installed inside the outer tube assembly 10, at this time: the latch a 221 on the latch mechanism 22 is in an open state and is confined in the latch chamber 110, so that the latch mechanism 22 is restrained by the latch chamber 110 and cannot move upward axially.

The latch suspension mechanism 26 is in an open state by the latch b 266 on the latch suspension mechanism 26 and is restrained by the middle tube sub 28, thereby restraining the latch suspension mechanism 26 such that the latch suspension mechanism 26 cannot move upward axially. The entire inner tube assembly 20 is not axially movable downward due to being restrained by the suspension ring 24. The inner tube assembly reaches the downward limit position, and the inner tube assembly 20 is restrained by the latch mechanism 22 and the latch suspension mechanism 26 so that the inner tube assembly 20 cannot move upward axially.

After the inner tube assembly 20 is successfully installed inside the outer tube assembly 10, the retrieving by wireline and coring process begins: the spearhead 21 drives the latch releasing tube 223 and the first spirol pin 233 on the latch releasing tube 223 to move upward axially along the pulling tube long pin hole 232 and the latch bracket tube long pin hole 225, and the first spirol pin 233 is lifted up to the top of the pulling tube long pin hole 232. Then, driven by the latch releasing tube 223, the first spirol pin 233 continues to move upward axially along the latch bracket tube long hole 225 and moves axially upward with the pulling tube 231, so that the spearhead 21 drives the lifting device 23 to move upward axially through the latch mechanism 22.

Before the first spirol pin 233 contacts the upper end of the latch bracket tube long pin hole 225, the first spirol pin 233 drives the latch bracket tube b 261 to move upward through the pulling tube 231 of the lifting device 23. The latch bracket tube b 261 drives the latch bracket tube inclined portion 268 to move upward axially. Before the latch bracket tube inclined portion 268 contacts the latch b 266, the latch bracket tube inclined portion 268 receives an upward pulling force, thereby cutting off the shear copper pin 29. The shear copper pin 29 is cut into one longer segment and two shorter segments. The two shorter segments of the shear copper pin 29 remain in the latch bracket tube inclined portion 268 and follow the latch bracket tube inclined portion 268 to move upward axially, so that the latch bracket tube inclined portion 268 can drive the second spirol pin 311 connected to the latch bracket tube inclined portion 268 to move upward axially along the spirol pin oblong hole 310 until the second spirol pin 311 contacts the top end of the spirol pin oblong hole 310. While the second spirol pin 311 contacts the top end of the spirol pin oblong hole 310, the latch bracket tube inclined portion 268 also contacts the latch b 266. The latch bracket tube b 261 continues to drive the latch bracket tube inclined portion 268 to move upward axially such that the contact b 266 breaks contact with the short tube section 28, to complete the latch releasing operation.

During the process where the two shorter segments of the shear copper pin 29 remain in the latch bracket tube inclined portion 268 and move upward axially along with the latch bracket tube inclined portion 268. The shorter portions of the cut-off shear copper pin 29 never pass over the topmost portion of the shear copper pin protection sleeve 30 so that the shorter portions of the cut-off shear copper pin 29 do not fall into the area between the inner tube assembly b 202 and the inner tube a 201, and thus the occurrence of jamming can be prevented.

Then, the entire latch suspension mechanism 26 can move upward axially, so that the latch suspension mechanism 26 sequentially drives the single-action mechanism 32, the sealing mechanism 40, the core barrel 48 and the basket core catcher 55 to move upward axially through the second spirol pin 311.

The spearhead 21 continues to drive the latch suspension mechanism 26, the single-action mechanism 32, the sealing mechanism 40, the core barrel 48 and the basket core catcher 55 to move upward axially through the latch releasing tube 223. The core barrel 48 and the basket core catcher 55 continue to move upward axially until the sealing joint shoulder 405 of the sealing mechanism 40 contacts the sealing short shoulder 371 of the sealing sub 37 to stop moving upward. That is, when the core barrel 48 reaches the upward limit position, the sealing joint shoulder 405 contacts the sealing sub shoulder 371, as shown in FIG. 18.

Before the latch releasing tube inclined portion 227 contacts the latch a 221, the core barrel 48 and the basket core catcher 55 are pulled upward from the through hole of the ball valve 5009 first, thereby dissipating the lateral resistance of the core barrel 48 to the ball valve 5009. That is, the core barrel 48 does not block the ball valve 5009 from flipping down. At this time, the ball valve 5009 moves downward as a whole along the ball valve sub oblong hole 5013 under the thrust given by the spring 5003. During the downward movement of the ball valve 5009, the ball valve closing sliding groove 5012 performs complex movement of sliding and rotating around the ball valve closing drive pin 5010 fixed on the ball valve sub 5008, while giving the ball valve 5009 a flipping torque and driving the ball valve 5009 to flip by 90°.

After the ball valve 5009 slides down and flips by 90°, the latch releasing tube inclined portion 227 contacts the latch a 221, so that the latch a 221 is disconnected from the latch chamber 110, and the latch releasing operation is completed. After the latch releasing operation is completed, the spearhead 21 drives the latch releasing tube 223 to continue to move upward axially, so that the entire inner tube assembly 20 can be pulled out from the outer tube assembly 10. That is, only after the inner tube assembly b 202 completes the latch releasing, the inner tube assembly b can move upward axially under the driving of the spearhead, and then the core sample of the inner tube assembly 20 is taken out, and the whole process of coring is completed.

The area between the upper portion of the ball valve 5009 contacting the upper ball valve seat 5007 to the lower portion of the sealing joint shoulder 405 contacting the sealing sub 37 is a stable pressure-retaining area, and the core barrel 48 containing the core sample is located in the pressure-retaining area, which ensures that the core is in the pressure-retaining area, so that the core is under a pressure-retaining state under high pressure, and the pressure is retained.

Various other changes and modifications may be made by those skilled in the art in light of the above-described technical solutions and concepts, and all such changes and modifications are intended to fall within the scope of the appended claims.

What is claimed is:

1. A natural gas hydrate rotary pressure-retaining corer, comprising: an outer tube assembly and an inner tube assembly mounted inside the outer tube assembly, the bottom end of the outer tube assembly being provided with a coring bit; wherein the inner tube assembly includes an inner tube assembly a and an inner tube assembly b, the inner tube assembly b is mounted inside the inner tube assembly a and is axially movable upward along the inner tube assembly a and is axially fixed in the inner tube assembly a through a latch suspension mechanism, the inner tube assembly b is axially kept and does not move, the inner tube assembly b can only move upward axially after completing latch releasing, the inner tube assembly a includes a spearhead, a latch mechanism, a long tube, a middle tube sub, a short joint, a sealing sub, a connecting tube, a middle tube and a pressure-retaining ball valve closing sealing mechanism sequentially connected from top to bottom; the inner tube assembly b includes a lifting device, a latch suspension mechanism, an spirol pin sub, a single-action mechanism, a dapter, an adjustment joint, a connecting tube, a sealing mechanism, a connecting long tube, a connecting long tube short joint and a core barrel sequentially connected from top to bottom; the latch mechanism and the latch suspension mechanism cooperate with each other, so that the core barrel is axially fixed before retrived by wireline;

the core barrel is located inside the middle tube;

the pressure-retaining ball valve closing sealing mechanism comprises a spring limit ring, a ball valve drive sleeve, a spring, a ball valve drive sleeve spring shoulder, a ball valve sub shoulder, an upper ball valve seat sealing ring, an upper ball valve seat, a ball valve sub, a ball valve, a ball valve closing drive pin, a ball valve shaft, a ball valve closing sliding groove, a ball valve sub oblong hole, a ball valve sub window, a lower ball valve seat, a lower ball valve seat seal ring, a load-bearing spring and a ball valve lower gland; and the ball valve is provided with the ball valve shaft and the ball valve closing sliding groove, and the ball valve is provided with a through hole for the core barrel to pass through;

the upper end of the ball valve sub is connected to the lower end of the middle tube, the ball valve sub sealing ring is arranged at the joint of the ball valve sub and the middle tube, the hollow interior of the ball valve sub is provided with the ball valve sub window, the middle of the ball valve sub is provided with the ball valve sub oblong hole, the ball valve closing drive pin located in the ball valve sub oblong hole is fixed on the ball valve sub, and the ball valve closing drive pin protrudes into the ball valve closing sliding groove of the ball valve;

the ball valve is fixedly disposed in the ball valve sub window of the ball valve sub through the ball valve shaft, one end of the ball valve shaft is connected to the ball valve, and the other end protrudes into the ball valve sub long hole, and can rotate and slide in the ball valve sub oblong hole;

the ball valve sub is internally provided with the upper ball valve seat and the lower ball valve seat, the upper ball valve seat and the lower ball valve seat can both slide axially in the ball valve sub, the upper end of the ball valve sub is provided with the ball valve sub shoulder, and the ball valve sub is connected to the middle tube;

the upper end of the upper ball valve seat is connected to the lower end of the ball valve drive sleeve, the lower end of the upper ball valve seat is in contact with the upper end of the ball valve, the ball valve drive sleeve is located below the connecting long tube sub, the ball valve drive sleeve is located between the core barrel and the middle tube, the spring is also provided between the ball valve drive sleeve and the middle tube, the spring is sleeved on the ball valve drive sleeve, the upper end of the spring is in contact with the spring limit ring, the spring limit ring is restricted by the middle tube shoulder by concave-convex fitting, the spring limit ring is located between the core barrel and the middle tube, the lower end of the spring is in contact with the ball valve drive sleeve spring shoulder and is held by the ball valve drive sleeve spring shoulder, the ball valve drive sleeve spring shoulder holds the spring limit ring through the spring, and the ball valve drive sleeve spring shoulder is located above the ball valve sub shoulder;

the pressure-retaining ball valve closing sealing mechanism cooperates with the core barrel to realize that the ball valve slides downward and flips by 90°; and the single-action mechanism is located inside the middle tube sub and is located below the spirol pin sub, the single-action mechanism is connected to the dapter through the bearing sleeve, the dapter is connected to the upper end of the adjustment joint, the adjustment joint is sleeved with an adjustment mechanism lock nut, the adjustment mechanism lock nut is disposed at the lower end of the dapter, the adjustment joint is located at the inner wall of the short joint, the lower end of the adjustment joint is connected to the upper end of the connecting tube, the lower end of the connecting tube is connected to the sealing mechanism; and the sealing mechanism is located inside the connecting tube and can move axially along the connecting tube.

2. The natural gas hydrate rotary pressure-retaining corer according to claim 1, wherein when the core barrel passes downward through the through hole of the ball valve, the edge of the ball valve is closely attached to the core barrel, the core barrel restrains the ball valve to flip down, at the same time the ball valve is contacted by the core barrel, so that the ball valve holds upward the upper ball valve seat, the spring limit ring is limited by the middle tube shoulder on the middle tube; when the core barrel is pulled upward from the through hole of the ball valve, the ball valve is disengaged from the core barrel and flips by 90°, and when the ball valve reaches a downward extreme position, the load-bearing spring is compressed to the lower ball valve seat to contact the ball valve lower gland.

3. The natural gas hydrate rotary pressure-retaining corer according to claim 1, wherein the lower end of the pressure-retaining ball valve closing sealing mechanism is connected to a flushing mechanism for flushing the core barrel, the flushing mechanism is provided with an outlet flow passage, the outlet passage is a gap between the outer tube coring bit and the cutting shoe and a gap between the core barrel and the cutting shoe.

4. The natural gas hydrate rotary pressure-retaining corer according to claim 1, wherein the sealing mechanism comprises a quick-plug check valve pressure measuring joint, a pressure passage, a sealing joint sealing ring, a sealing joint and a sealing joint shoulder, the upper end of the sealing joint is connected to the lower end of the connecting tube, the middle portion of the sealing joint is provided with the axial pressure passage, the quick-plug check valve pressure measuring joint protrudes into the pressure passage, the sealing joint is sleeved with the sealing joint sealing ring, the sealing joint is provided with the sealing joint shoulder on each side, and the lower end of the sealing joint is connected to the upper end of the connecting long tube.

5. The natural gas hydrate rotary pressure-retaining corer according to claim 1, wherein the attachment between the ball valve sub and the upper ball valve seat is provided with the upper ball valve seat sealing ring, the attachment between the ball valve sub and the lower ball valve seat is provided with the lower joint valve seat sealing ring; the lower ball valve seat is provided with the load-bearing spring and the ball valve lower gland from top to bottom, the upper and lower ends of the load-bearing spring are respectively connected to the lower ball valve seat and the ball valve lower gland, and the upper end of the lower ball valve seat is in contact with the lower end of the ball valve.

6. The natural gas hydrate rotary pressure-retaining corer according to claim 1, wherein the ball valve and the lower ball valve seat are in floating contact.

7. The natural gas hydrate rotary pressure-retaining corer according to claim 1, wherein the latch mechanism comprises a latch a, a latch bracket a, a latch releasing tube, an inlet, a latch bracket long pin hole, a latch bracket tube a, and a latch releasing tube inclined portion, the latch a is disposed in the latch chamber, and is connected to the latch bracket a, the latch bracket a is connected and disposed inside the latch releasing tube, the latch releasing tube is fixedly connected to the spearhead, the bottom end of the latch releasing tube is provided with the latch releasing tube inclined portion for removing the latch from the latch chamber, the inlet is provided on the side wall of the latch releasing tube, and the latch bracket tube long pin hole is disposed inside the middle cavity of the latch bracket tube a.

8. The natural gas hydrate rotary pressure-retaining corer according to claim 1, wherein the lifting device comprises a pulling tube, a pulling tube long pin hole and a first spirol pin, the pulling tube long pin hole is disposed inside the pulling tube; the first spirol pin is fixedly disposed on the latch releasing tube after passing through the latch bracket tube long pin hole and the pulling tube long pin hole, the central axes of the latch bracket tube long pin hole and the pulling tube long pin hole are on the same straight line, and the pulling tube, the latch bracket tube a and the latch releasing tube adopt a sleeve connection.

9. The natural gas hydrate rotary pressure-retaining corer according to claim 1, wherein the latch suspension mechanism comprises a latch bracket tube b, a latch bracket tube outlet, a latch bracket b, a latch chamber, a latch sheet opening, a latch b, a latch chamber, a latch bracket tube inclined portion and a shearing copper pin; the upper portion of the latch suspension mechanism is disposed inside the long tube, and the lower portion is disposed inside the middle tube sub.

10. The natural gas hydrate rotary pressure-retaining corer according to claim 1, wherein the single-action mechanism comprises an upper thrust bearing, a mandrel, a copper sleeve, a bearing sleeve, a lower thrust bearing and a lock nut, the upper end of the mandrel is screwed to the bottom end of the spirol pin sub, the bearing sleeve is sleeved on the mandrel, the copper sleeve is arranged between the bearing sleeve and the mandrel, the upper and lower ends of the copper sleeve are respectively provided with the upper thrust bearing and the lower thrust bearing, the lock nut is provided at the bottom end of the mandrel, and the lower thrust bearing is located above the lock nut.

* * * * *